US012638227B2

(12) United States Patent
Lee et al.

(10) Patent No.: US 12,638,227 B2
(45) Date of Patent: May 26, 2026

(54) REFRIGERATOR

(71) Applicant: SAMSUNG ELECTRONICS CO., LTD., Suwon-si (KR)

(72) Inventors: Sihoon Lee, Suwon-si (KR); Jongeun Kim, Suwon-si (KR); Myoungjin Jang, Suwon-si (KR); Jinhong Yu, Suwon-si (KR); Jisick Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 257 days.

(21) Appl. No.: 18/375,807

(22) Filed: Oct. 2, 2023

(65) Prior Publication Data

US 2024/0219096 A1 Jul. 4, 2024

Related U.S. Application Data

(63) Continuation of application No. PCT/KR2023/014015, filed on Sep. 18, 2023.

(30) Foreign Application Priority Data

Jan. 4, 2023 (KR) ..... 10-2023-0001429

(51) Int. Cl.
*F25D 17/04* (2006.01)
*F25D 25/02* (2006.01)

(52) U.S. Cl.
CPC ..... *F25D 17/045* (2013.01); *F25D 25/028* (2013.01)

(58) Field of Classification Search
CPC ..... F25D 17/045; F25D 25/028
See application file for complete search history.

(56) References Cited

U.S. PATENT DOCUMENTS 4,870,836 A 10/1989 Pink
7,306,304 B2 12/2007 Jang
(Continued)

FOREIGN PATENT DOCUMENTS

JP 8-226742 A 9/1996
JP 2001-174125 A 6/2001
(Continued)

OTHER PUBLICATIONS

International Search Report (PCT/ISA/210) issued on Jan. 17, 2024 by the International Searching Authority in International Patent Application No. PCT/KR2023/014015.
(Continued)

*Primary Examiner* — Cassey D Bauer
(74) *Attorney, Agent, or Firm* — Sughrue Mion, PLLC

(57) ABSTRACT

Provided is a refrigerator including: a storage compartment; a cold air outlet configured to supply cold air to the storage compartment; and a shelf disposed within the storage compartment, the shelf including: a cold air communication hole formed at a position corresponding to the cold air outlet; a shelf body including a support wall; a shelf base below the shelf body and coupled to the shelf body, the shelf base including a bottom wall covering the support wall and forming a gap between the bottom wall and the support wall; and a cold air control lever between the bottom wall and the support wall and supported by the bottom wall, the cold air control lever being configured to open and close the cold air communication hole.

18 Claims, 42 Drawing Sheets

(56) References Cited

U.S. PATENT DOCUMENTS

| | | | | |
|---|---|---|---|---|
| 10,030,907 | B2 | 7/2018 | Kocaturk et al. | |
| 11,408,662 | B2 | 8/2022 | Lee et al. | |
| 11,435,127 | B2 | 9/2022 | Song et al. | |
| 2006/0248916 | A1* | 11/2006 | Kim | F25D 25/025 62/187 |
| 2009/0199587 | A1 | 8/2009 | Matthews et al. | |
| 2021/0348826 | A1 | 11/2021 | Heo et al. | |
| 2022/0364783 | A1 | 11/2022 | Kang et al. | |

FOREIGN PATENT DOCUMENTS

| | | | |
|---|---|---|---|
| JP | 3751075 | B2 | 3/2006 |
| JP | 4641967 | B2 | 3/2011 |
| JP | 2011-80691 | A | 4/2011 |
| JP | 2022-37080 | A | 3/2022 |
| KR | 95-20179 | U | 7/1995 |
| KR | 20-0126271 | Y1 | 11/1998 |
| KR | 10-0653350 | B1 | 12/2006 |
| KR | 10-0653351 | B1 | 12/2006 |
| KR | 10-0653352 | B1 | 12/2006 |
| KR | 10-0653353 | B1 | 12/2006 |
| KR | 10-0653354 | B1 | 12/2006 |
| KR | 10-0653355 | B1 | 12/2006 |
| KR | 10-0657932 | B1 | 12/2006 |
| KR | 10-0657933 | B1 | 12/2006 |
| KR | 10-0674038 | B1 | 1/2007 |
| KR | 10-0674039 | B1 | 1/2007 |
| KR | 10-0675335 | B1 | 1/2007 |
| KR | 10-0745779 | B1 | 8/2007 |
| KR | 10-0766060 | B1 | 10/2007 |
| KR | 10-0776027 | B1 | 11/2007 |
| KR | 10-0836809 | B1 | 6/2008 |
| KR | 10-0872856 | B1 | 12/2008 |
| KR | 10-2009-0133010 | A | 12/2009 |
| KR | 10-1060398 | B1 | 8/2011 |
| KR | 10-2011-0136570 | A | 12/2011 |
| KR | 10-1203571 | B1 | 11/2012 |
| KR | 10-1203572 | B1 | 11/2012 |
| KR | 10-1815580 | B1 | 1/2018 |
| KR | 10-2021-0026471 | A | 3/2021 |
| KR | 10-2021-0136367 | A | 11/2021 |
| KR | 10-2022-0155156 | A | 11/2022 |

OTHER PUBLICATIONS

Written Opinion (PCT/ISA/237) issued on Jan. 17, 2024 by the International Searching Authority in International Patent Application No. PCT/KR2023/014015.

Communication issued on Nov. 27, 2025 by the European Patent Office in European Patent Application No. 23914893.5.

* cited by examiner

REFRIGERATOR

CROSS-REFERENCE TO RELATED APPLICATIONS

This application is a by-pass continuation of International Application No. PCT/KR2023/014015, filed on Sep. 18, 2023, which is based on and claims priority to Korean Patent Application No. 10-2023-0001429, filed on Jan. 4, 2023, in the Korean Intellectual Property Office, the disclosures of which are incorporated by reference herein in their entireties.

BACKGROUND

1. Field

The present disclosure relates to a refrigerator, and more particularly, to a refrigerator including a cold air control device.

2. Description of Related Art

A refrigerator is a home appliance that may keep food fresh by including a storage compartment for storing food and a cold air supply device for supplying cold air to the storage compartment.

A temperature in the storage compartment is maintained within a certain range required to keep food fresh. The storage compartment of such a refrigerator is provided such that a front side thereof is opened, and the open front side is normally closed by a door to keep the temperature of the storage compartment.

A shelf is provided inside the storage compartment to divide the storage compartment into a plurality of spaces. The shelf is generally provided to be withdrawable from the storage compartment.

SUMMARY

Provided is a refrigerator having a space in which a temperature in a refrigerating compartment is separately maintained.

Also, provided is a refrigerator in which a temperature in a space formed by a shelf is controlled by adjusting an amount of cold air introduced therein.

Also, provided is a refrigerator including a shelf guiding a movement of a cold air control lever.

Also, provided is a refrigerator in which a length of a cold air control lever is adjusted.

Technical tasks to be achieved in this document are not limited to the technical tasks mentioned above, and other technical tasks not mentioned will be clearly understood by those skilled in the art from the description below.

According to an aspect of the disclosure, a refrigerator includes: a storage compartment; a cold air outlet configured to supply cold air to the storage compartment; and a shelf disposed within the storage compartment, the shelf including: a cold air communication hole formed at a position corresponding to the cold air outlet; a shelf body including a support wall; a shelf base below the shelf body and coupled to the shelf body, the shelf base including a bottom wall covering the support wall and forming a gap between the bottom wall and the support wall; and a cold air control lever between the bottom wall and the support wall and supported by the bottom wall, the cold air control lever being configured to open and close the cold air communication hole.

The cold air control lever may be configured to slide between a first position in which the cold air communication hole is open and a second position in which the cold air communication hole is closed, and the cold air control lever may be supported by a closed base surface of the shelf base.

The cold air control lever may include a first cold air control lever and a second cold air control lever, wherein the first cold air control lever includes a switch inserted into a front opening of the shelf body, and wherein the second cold air control lever is disposed at a rear of the first cold air control lever and is configured to open and close the cold air communication hole.

The first cold air control lever may further include a connection part extending toward a rear direction of the shelf and toward the second cold air control lever, and a guider extending from the connection part in a moving direction of the first cold air control lever, and the shelf body may further include a guide rib on a bottom surface of the shelf body, wherein the guide rib extends in a moving direction of the guider, and wherein the bottom surface of the shelf body is in contact with one surface of the guider and is configured to guide a movement of the guider.

The cold air control lever may include a first wall configured to open and close the cold air communication hole, and a second wall disposed at the rear of the first wall and spaced apart from the first wall.

The shelf base may further include a stopper configured to come into contact with the cold air control lever when the cold air control lever is in one of the first position and the second position.

The shelf base may further include a guide wall extending along a moving direction of the first cold air control lever, the guide wall may include a front surface, and the first cold air control lever may include a seating part disposed at the rear of the switch and configured to be seated on the guide wall.

The first cold air control lever may further include a guide plate, wherein the guide plate extends in the moving direction of the first cold air control lever and includes an elastic protrusion protruding toward the front surface of the guide wall, and the shelf base may further include an interference rib formed on the front surface and configured to interfere with the elastic protrusion as the first cold air control lever is moved from the first position or the second position.

The shelf base may further include a hook protrusion protruding toward the shelf body, and the shelf body may further include an interference protrusion protruding toward the shelf base and configured to interfere with the hook protrusion.

The shelf base may further include a guide hole disposed adjacent to the hook protrusion and formed on a bottom surface of the shelf base.

The shelf base may further include a closed rib surrounding the guide hole, the closed rib configured to protrude toward and come into contact with the shelf body.

The shelf body may further include a cover rib formed on a bottom surface of the shelf body and configured to extend between the shelf body and the shelf base and to prevent a part of the cold air supplied by the cold air outlet from being introduced into the gap.

The second cold air control lever may include a supporter configured to receive and support the first cold air control lever.

The shelf body may further include an insertion rib extending in a rear direction of the shelf and protruding from a bottom surface of the shelf body toward the shelf base, and the shelf base may further include a pair of support ribs extending in the rear direction and forming an insertion groove configured to receive the insertion rib.

The shelf base may further include a rear rib disposed below the first wall and the second wall and protruding from a rear surface of the shelf base to extend downward, wherein the rear rib is configured to guide frost formed between the first wall and the second wall downward.

According to an aspect of the disclosure, a shelf assembly includes: a shelf body comprising a support wall and a rear wall, the rear wall comprising an opening configured to allow air to enter the shelf body; a shelf base positioned below the shelf body and configured to be coupled to the shelf body, the shelf base comprising a bottom wall configured to cover the support wall and to form a gap between the bottom wall and the support wall; and an air control lever disposed between the bottom wall and the support wall, supported by the bottom wall, and configured to open and close the opening.

The air control lever may be configured to slide between a first position in which the opening is open and a second position in which the opening is closed, and the air control lever may be supported by a closed base surface.

The air control lever may include a first air control lever and a second air control lever, wherein the first air control lever may include a switch inserted into a front opening of the shelf body, and the second air control lever may be disposed at a rear of the first air control lever and may be configured to open and close the opening.

The first air control lever may further include a connection part extending toward a rear direction of the shelf and toward the second air control lever, and a guider extending from the connection part in a moving direction of the first air control lever, and the shelf body may further include a guide rib disposed on a bottom surface of the shelf body, wherein the guide rib extends in a moving direction of the guider, and wherein the bottom surface of the shelf body is in contact with one surface of the guider and is configured to guide a movement of the guider.

The air control lever may include a first wall configured to open and close the opening, and a second wall disposed at the rear of the first wall and spaced apart from the first wall.

According to one or more embodiments of the present disclosure, because a cold air control lever of a shelf can open and close a cold air communication hole, a temperature in a separate refrigerating compartment formed by the shelf can be controlled.

According to one or more embodiments of the present disclosure, because an insulating space is formed between a shelf body and a shelf base, the temperature in the separate refrigerating compartment formed by the shelf can be controlled.

According to one or more embodiments of the present disclosure, because a movement of the cold air control lever is guided to the shelf body or the shelf base, the cold air control lever can slide without rotating.

According to one or more embodiments of the present disclosure, because a length of the cold air control lever can be adjusted, the cold air control lever can be used in refrigerators of various sizes, increasing the usefulness of the cold air control lever.

According to one or more embodiments of the present disclosure, because a first opening/closing wall and a second opening/closing wall of the cold air control lever are spaced apart from each other in a front-rear direction and frost is formed therebetween, frost formation on a front surface of the first opening/closing wall can be prevented.

According to one or more embodiments of the present disclosure, the frost may be guided to a floor by a shape of a rear rib disposed below the first opening/closing wall and the second opening/closing wall of the cold air control lever.

Effects obtainable from the present disclosure are not limited to the effects mentioned above, and other effects not mentioned will be clearly understood by those skilled in the art from the description below.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
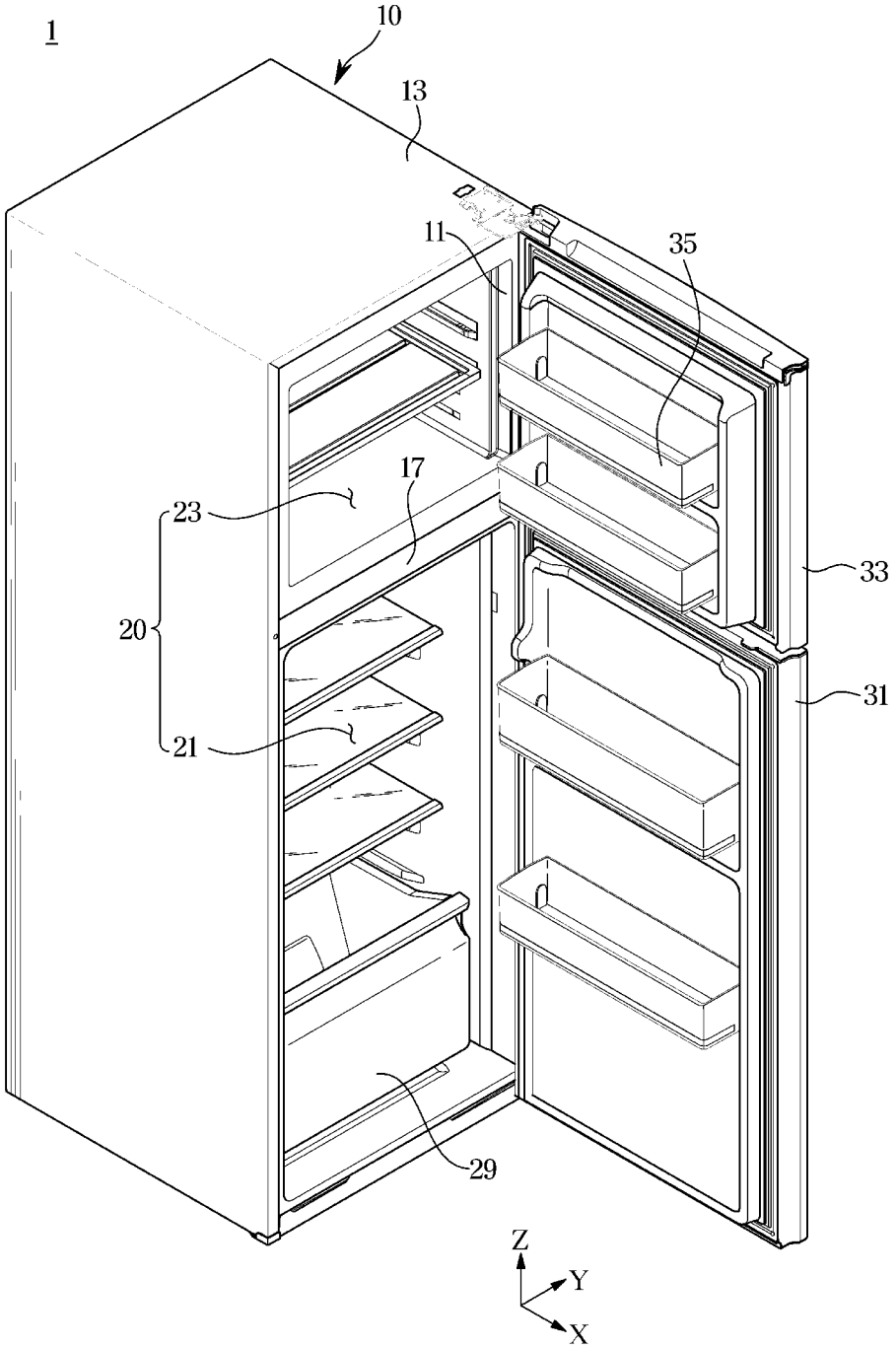
FIG. 1 is a perspective view of a refrigerator according to an embodiment of the present disclosure.

The embodiments described in the present specification and the configurations shown in the drawings are only examples of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, components, parts, or combinations thereof described in the specification, and do not exclude the presence or addition of one or more other features, numbers, steps, operations, components, parts, or combinations thereof.

It will be understood that, although the terms first, second, etc. may be used herein to describe various components, these components should not be limited by these terms, and the terms are only used to distinguish one component from another. For example, without departing from the scope of the present disclosure, a first component may be referred to as a second component, and similarly, the second component may also be referred to as a first component. The term "and/or" includes any combination of a plurality of related items or any one of a plurality of related items. Herein, the expression "at least one of a, b or c" indicates "only a," "only b," "only c," "both a and b," "both a and c," "both b and c," or "all of a, b, and c."

In this specification, the terms "up-down direction," "lower portion" and "front-rear direction" used in the following description are defined with reference to the drawings, and the shape and position of each component are not limited by these terms.

Hereinafter, embodiments of the present disclosure will be described in detail with reference to the accompanying drawings.

Figure 2:
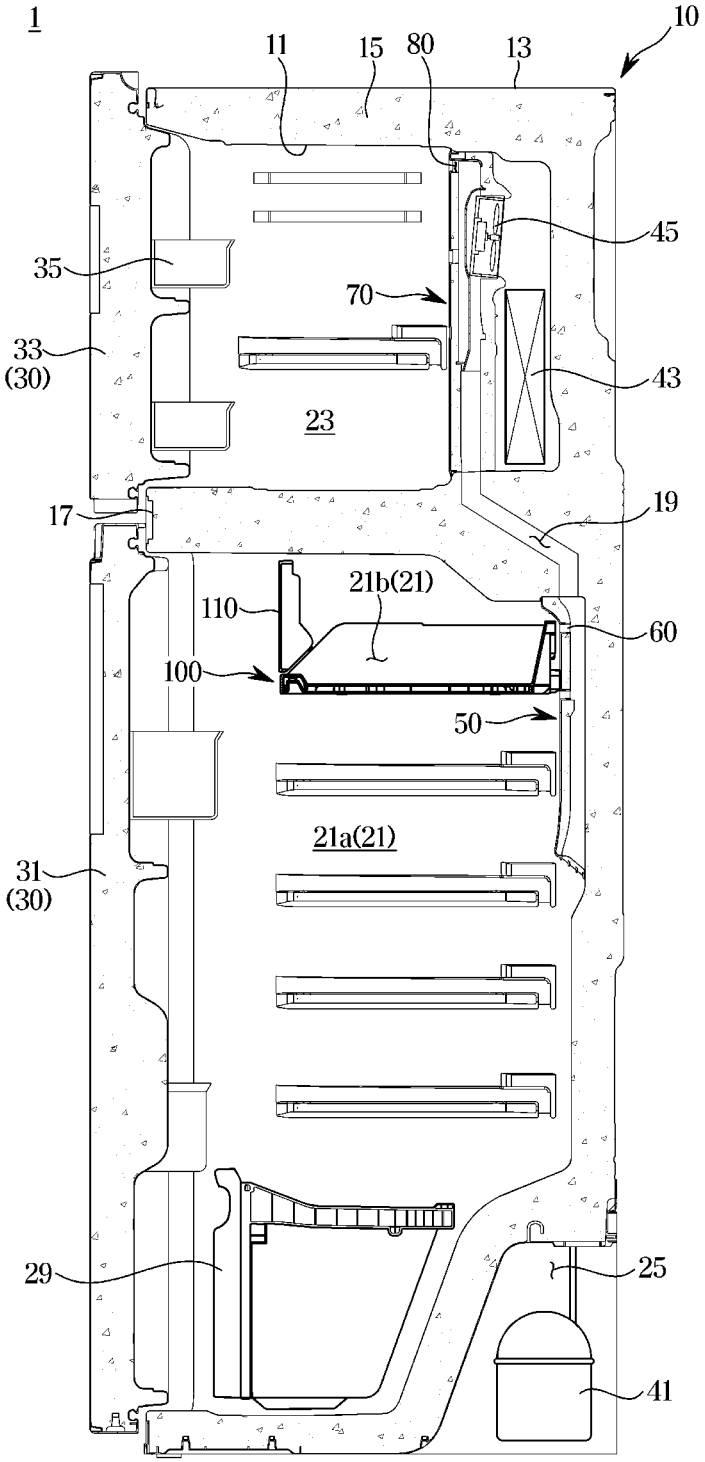
FIG. 2 is a side cross-sectional view of a refrigerator according to an embodiment of the present disclosure.
Figure 3:
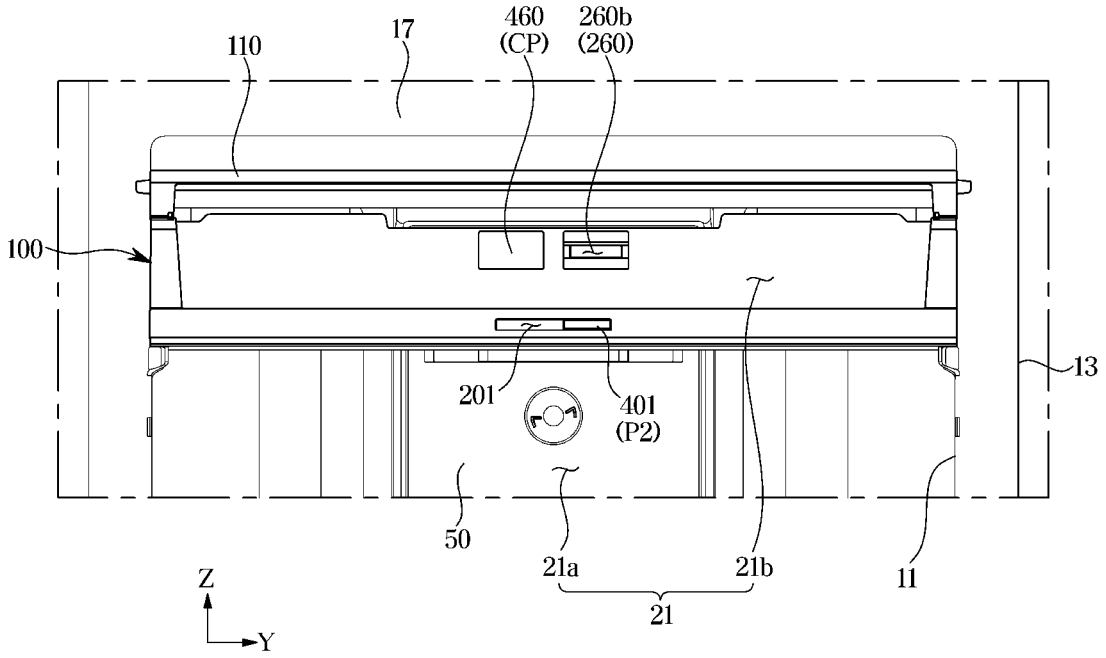
FIG. 3 is an enlarged front view illustrating a shelf mounted in a storage compartment of a refrigerator according to an embodiment of the present disclosure.

FIG. 1 is a perspective view of a refrigerator according to an embodiment of the present disclosure. FIG. 2 is a side cross-sectional view of a refrigerator according to an embodiment of the present disclosure. FIG. 3 is an enlarged front view illustrating a shelf mounted in a storage compartment of a refrigerator according to an embodiment of the present disclosure.

Referring to FIGS. 1 to 3, a refrigerator 1 may include a main body 10, a storage compartment 20 formed to be vertically partitioned inside the main body 10, a door 30 provided to open and close the storage compartment 20, and a cold air supply device provided to supply cold air to the storage compartment 20.

The main body 10 may include an inner case 11 forming the storage compartment 20 and an outer case 13 forming an exterior. An insulator 15 may be foamed between the inner case 11 and the outer case 13 to prevent leakage of cold air in the storage compartment 20.

A machine room 25 in which a compressor 41 for compressing a refrigerant and a condenser for condensing the refrigerant compressed by the compressor 41 are installed may be provided at a lower rear side of the main body 10.

The storage compartment 20 may be partitioned into a refrigerating compartment 21, which is a lower storage compartment provided at a lower portion of the main body 10, and a freezing compartment 23, which is an upper storage compartment provided at an upper portion of the main body 10, by the partition wall 17. That is, the freezing compartment 23 may be provided at the upper portion of the main body 10, and the refrigerating compartment 21 may be provided at a lower portion of the freezing chamber 23. As described above, an embodiment of the present disclosure may be in the form of a top mounted freezer (TMF), but is not limited thereto.

A plurality of support shelves 27 capable of stacking and storing food and the like may be provided at the upper portion of the inside of the storage compartment 20. In addition, a storage container 29 into which food and the like may be put and stored may be provided inside the storage compartment 20.

The refrigerating compartment 21 and the freezing compartment 22 may be opened and closed by a refrigerating compartment door 31 and a freezing compartment door 33, which are rotatably coupled to the main body 10, respectively, and a plurality of door guards 35 capable of accommodating food and the like may be installed on a rear surface of the door 30.

The refrigerator 1 may include the cold air supply device provided to supply cold air to the storage compartment 20.

The cold air supply device may include the compressor 41 installed in the machine room 25 to compress the refrigerant, the condenser installed in the machine room 25 to condense the compressed refrigerant, an expansion valve provided to expand the refrigerant condensed by the condenser, an evaporator 43 installed on a rear surface of the storage compartment 20 to generate cold air, and a fan 45 provided to guide the cold air generated from the evaporator 43 to be supplied to the storage compartment 20.

The cold air supply device may also include cold air ducts 50 and 70 provided to guide the cold air induced by the fan 45 to the storage compartment 20 so as to be discharged to the storage compartment 20. The cold air ducts 50 and 70 may include the freezing compartment cold air duct 70 disposed at the rear of the freezing compartment 23. The freezing compartment cold air duct 70 may include a plurality of cold air outlets 80 through which the cold air generated by the evaporator 43 is discharged into the freezing compartment 23. That is, cold air may be supplied into the freezing compartment 23 through the cold air outlets 80. The evaporator 43 and the fan 45 may be installed inside the freezing compartment cold air duct 70. However, hereinafter, the configuration of the cold air outlets may be referred to as a cold air outlet 60 through which cold air is discharged toward the refrigerating compartment 21.

The cold air ducts 50 and 70 may include the refrigerating compartment cold air duct 50 disposed at the rear of the refrigerating compartment 21. The refrigerating compartment cold air duct 50 may be connected to the freezing compartment cold air duct 70 through a connection flow path 19 formed in the partition wall 17. Therefore, the cold air generated by the evaporator 43 installed in the freezing compartment cold air duct 70 may be transferred to the refrigerating compartment cold air duct 50 through the connection flow path 19. The refrigerating compartment cold air duct 50 may include the plurality of cold air outlets 60 provided to allow the cold air transferred through the connection flow path 19 to be discharged into the refrigerating compartment 21. That is, cold air may be supplied into the refrigerating compartment 21 through the cold air outlets 60.

The refrigerator 1 may include a shelf 100 positioned below the partition wall 17. The shelf 100 may be slidably movable with respect to sidewalls of the inner case 11 to be drawn out of the storage compartment 21. The shelf 100 may be supported by the side walls of the inner case 11.

The shelf 100 may include a shelf cover 110 provided to open and close the front of the shelf 100. Because the shelf cover 110 may be hinged to the sidewalls of the inner case 11, when the shelf 100 is withdrawn from or inserted into the refrigerating compartment 21, the shelf cover 110 may be rotatable. The shelf cover 110 is disposed above the shelf 100 to partition a second refrigerating compartment 21*b* partitioned by the shelf 100 and the shelf cover 110 from a first refrigerating compartment 21*a* of the refrigerating compartment 21.

The shelf 100 may include a cold air communication hole 260 formed at a position corresponding to the cold air outlet 60 of the refrigerating compartment cold air duct 50. The cold air communication hole 260 may be configured to guide the cold air discharged from the cold air outlet 60 to the second refrigerating compartment 21*b* formed by the shelf 100 in correspondence with the position of the cold air outlet 60. For example, the refrigerating compartment cold air duct 50 may include a pair of the cold air outlets 60 provided to discharge cold air toward the shelf 100. The pair of cold air outlets 60 may include a first cold air outlet 60*a* and a second cold air outlet 60*b*.

The shelf 100 may include a pair of the cold air communication holes 260 formed at positions corresponding to the pair of cold air outlets 60, respectively. The pair of cold air communication holes 260 may include a first cold air communication hole 260*a* corresponding to the first cold air outlet 60*a* and a second cold air communication hole 260*b* corresponding to the second cold air outlet 60*b*.

The cold air communication hole 260 corresponds to the position of the cold air outlet 60 so that cold air may be guided from the cold air outlet 60 to the second refrigerating compartment 21*b*. The first cold air communication hole 260*a* of the pair of cold air communication holes 260 may be opened and closed by a cold air control lever 400. The cold air control lever 400 may slide in a horizontal direction (e.g., Y direction), and may be provided to open and close the first cold air communication hole 260*a* to keep the second refrigerating compartment 21*b* at a temperature different from that of the first refrigerating compartment 21*a*.

For example, the first refrigerating compartment 21*a* may be maintained at 0 degrees Celsius to 6 degrees Celsius. The second refrigerating compartment 21*b* may be maintained at a temperature of about −1 degree Celsius. As such, the second refrigerating compartment 21*b* may be controlled to a temperature different from that of the first refrigerating compartment 21*a* by the shelf cover 110, the first cold air communication hole 260*a* that is opened and closed, and an insulation structure, which will be described later.

Figure 4:
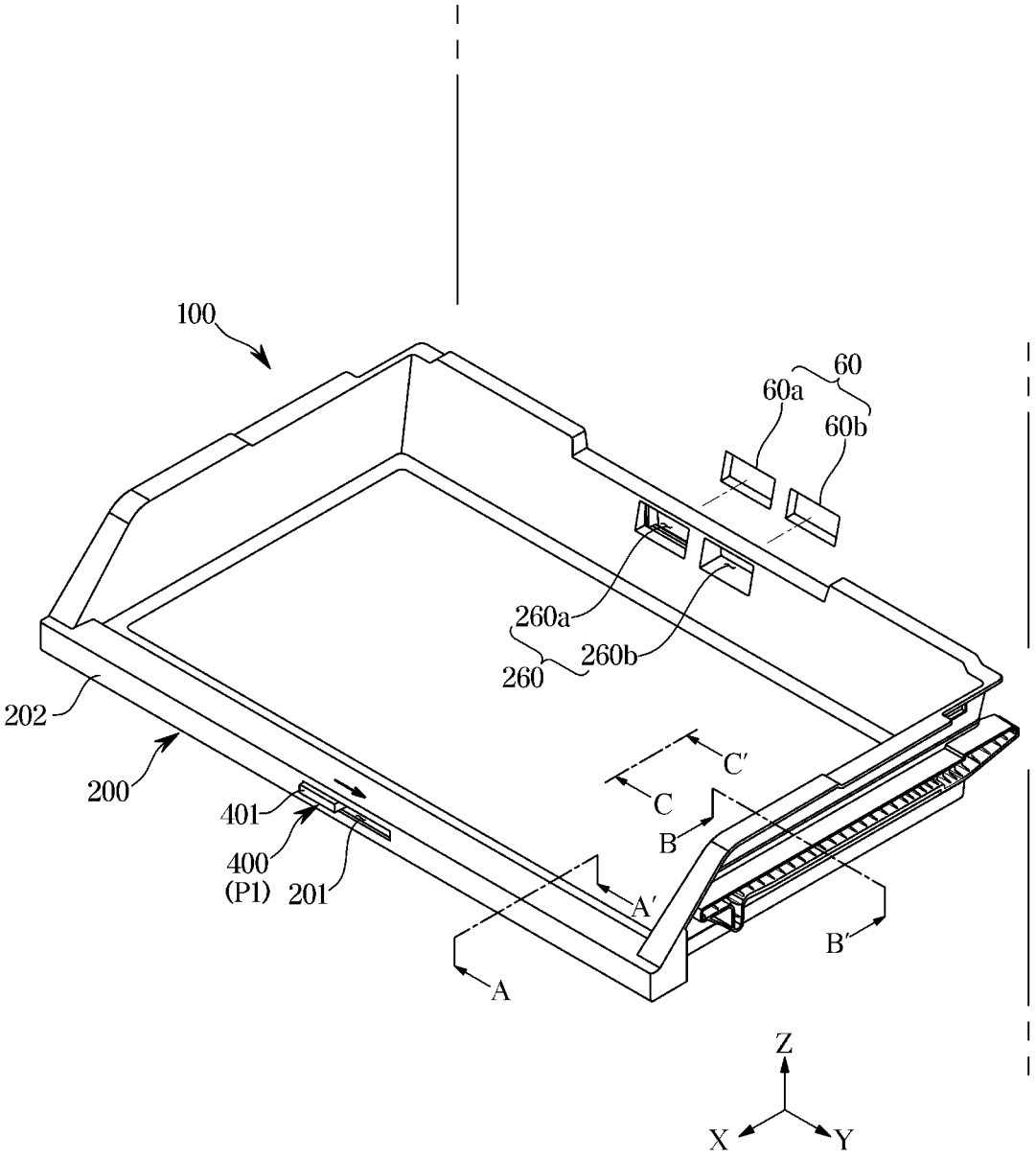
FIG. 4 is a perspective view of a shelf illustrating that a first cold air communication hole corresponding to a first cold air outlet of a refrigerator according to an embodiment of the present disclosure is opened.
Figure 5:
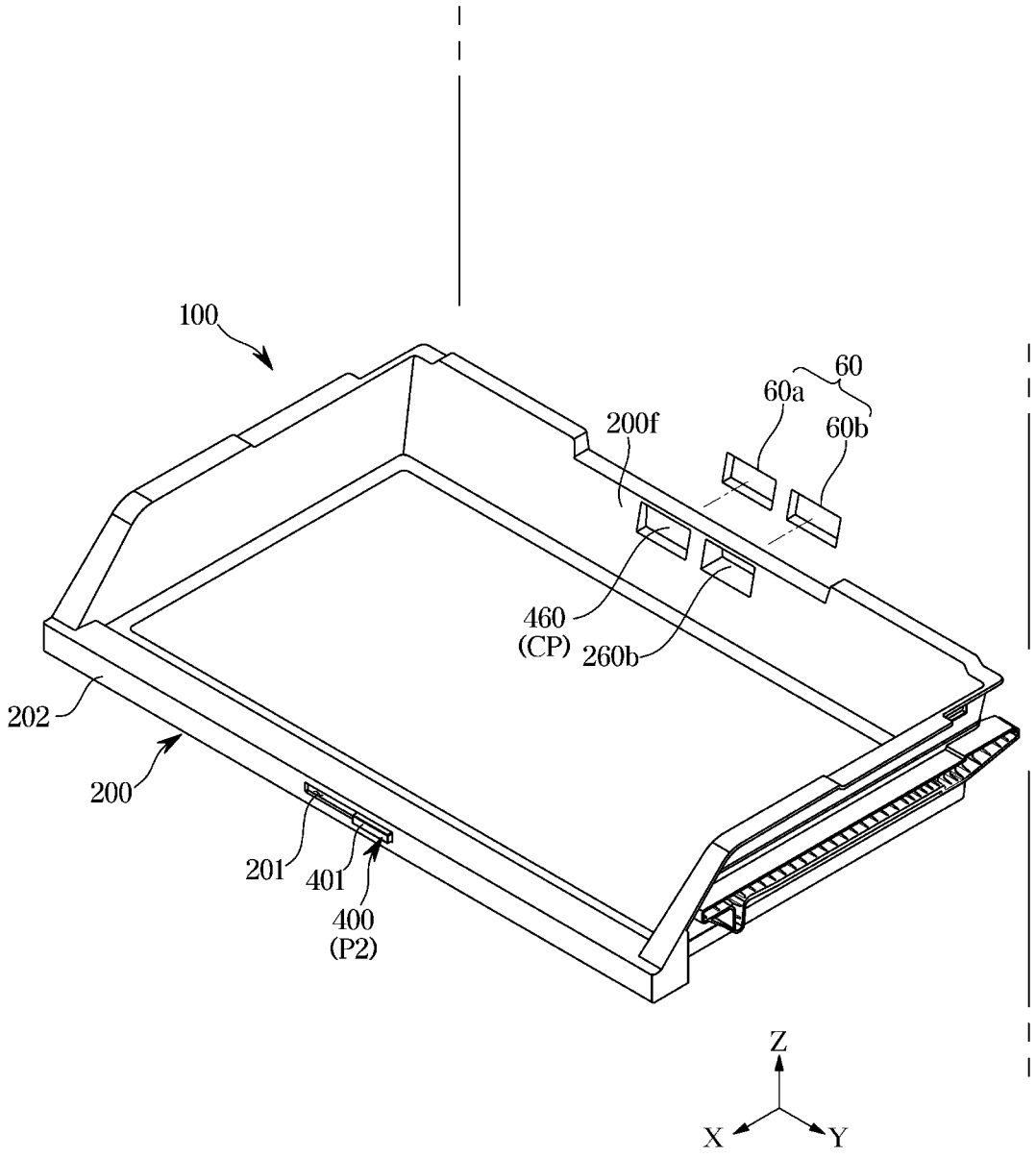
FIG. 5 is a perspective view of a shelf illustrating that the first cold air communication hole corresponding to a first cold air outlet of a refrigerator according to an embodiment of the present disclosure is closed.
Figure 6:
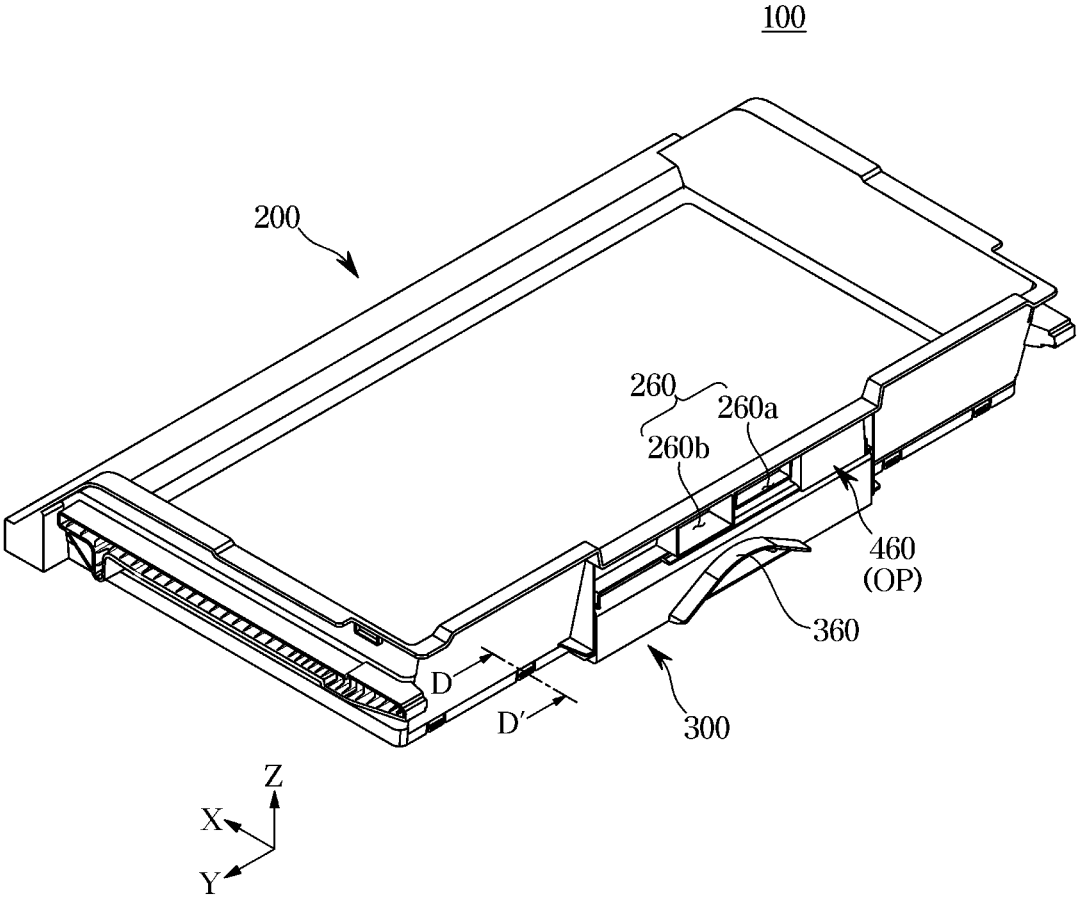
FIG. 6 is a rear perspective view of a shelf according to an embodiment of the present disclosure.
Figure 7:
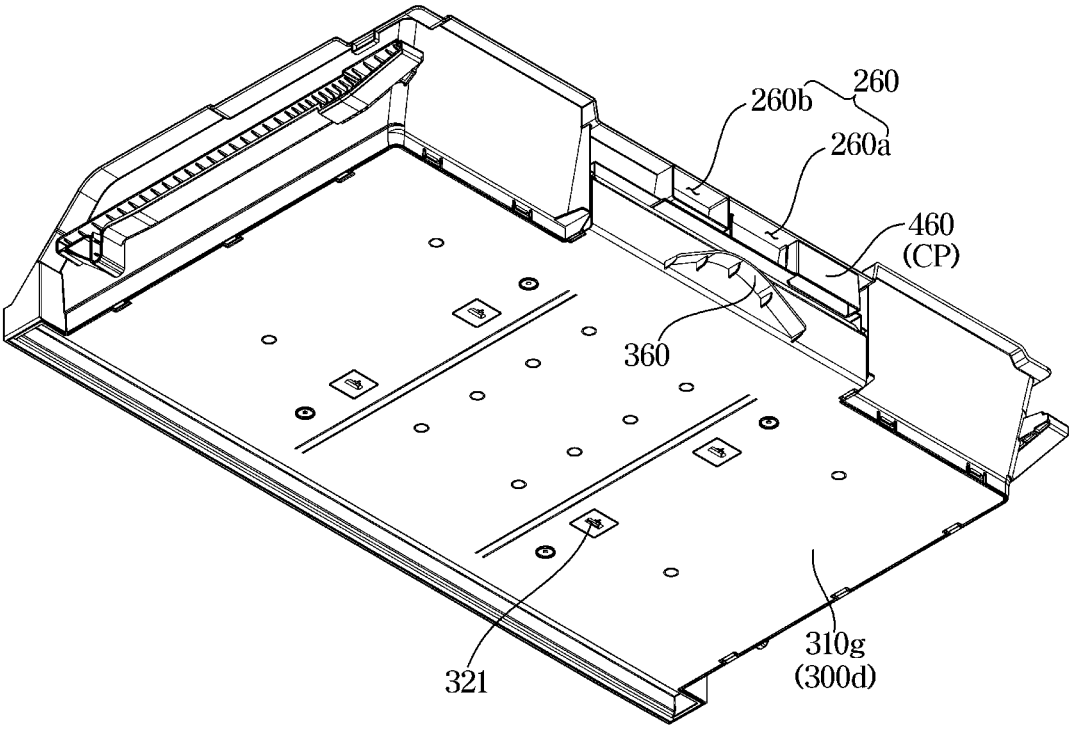
FIG. 7 is a bottom perspective view of a shelf according to an embodiment of the present disclosure.
Figure 8:
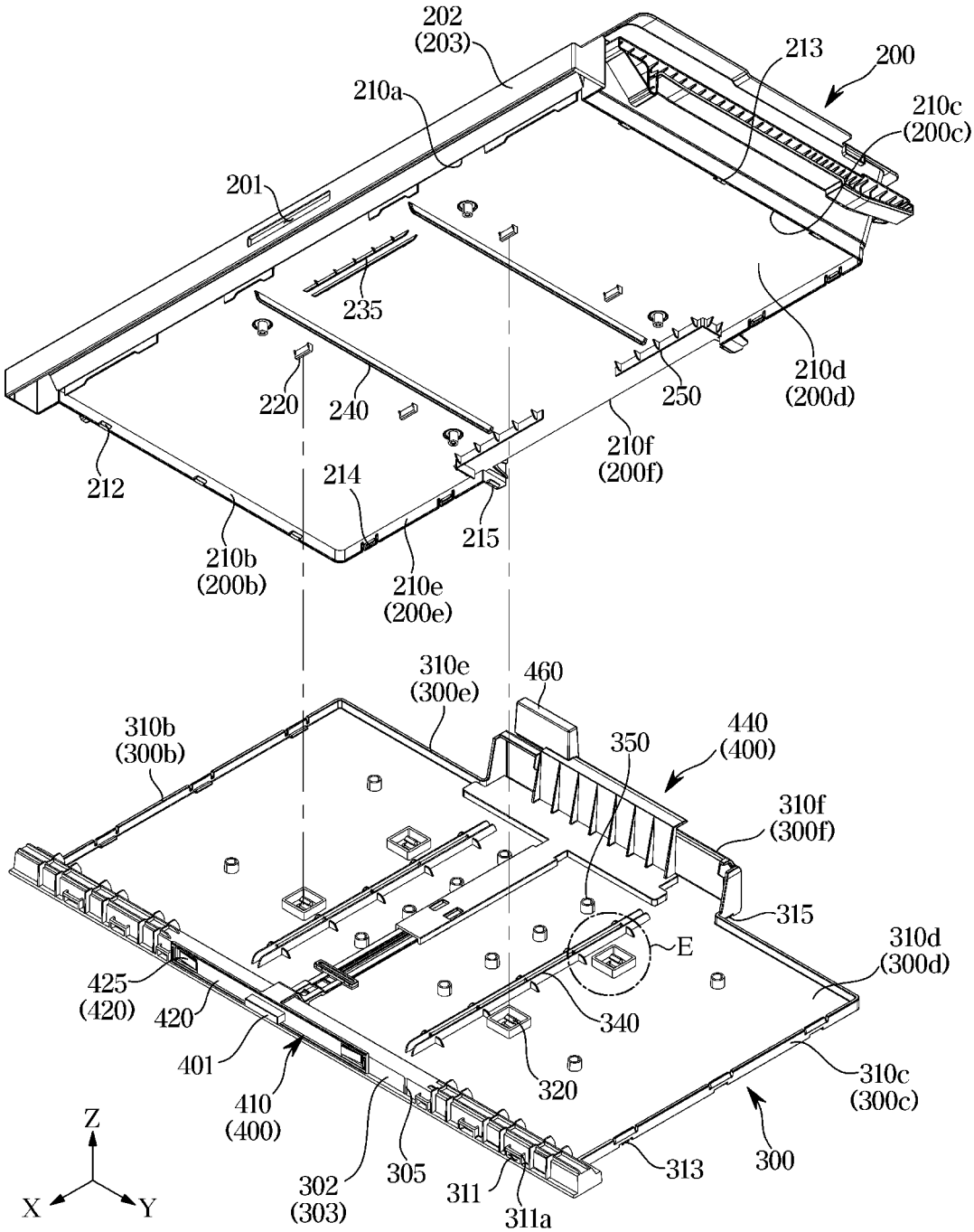
FIG. 8 is an exploded perspective view in which a shelf body and a shelf base of the shelf are separated according to an embodiment of the present disclosure.
Figure 9:
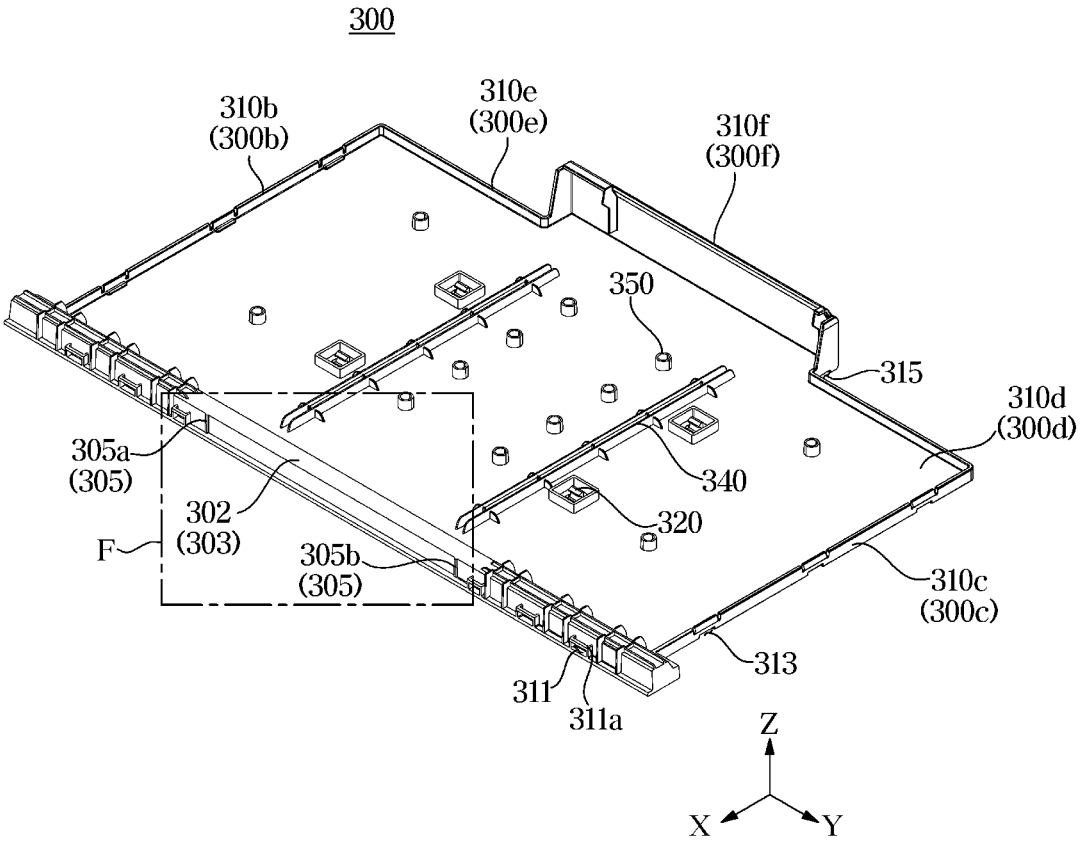
FIG. 9 is a perspective view of a shelf base according to an embodiment of the present disclosure.
Figure 10:
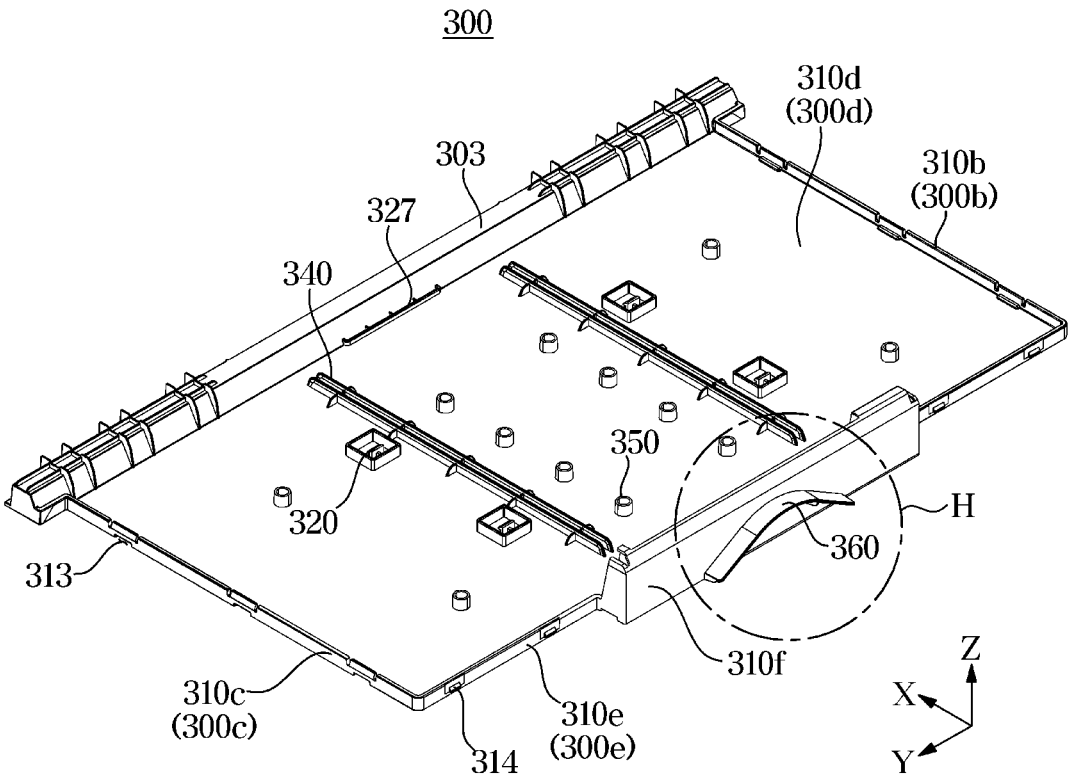
FIG. 10 is a rear perspective view of a shelf base according to an embodiment of the present disclosure.

FIG. 4 is a perspective view of a shelf illustrating that a first cold air communication hole corresponding to a first cold air outlet of a refrigerator according to an embodiment of the present disclosure is opened. FIG. 5 is a perspective view of a shelf illustrating that a first cold air communication hole corresponding to a first cold air outlet of a refrigerator according to an embodiment of the present disclosure is closed. FIG. 6 is a rear perspective view of a shelf according to an embodiment of the present disclosure. FIG. 7 is a bottom perspective view of a shelf according to an embodiment of the present disclosure. FIG. 8 is an exploded perspective view in which a shelf body and a shelf base of a shelf are separated according to an embodiment of the present disclosure. FIG. 9 is a perspective view of a shelf base according to an embodiment of the present disclosure. FIG. 10 is a rear perspective view of a shelf base according to an embodiment of the present disclosure.

Referring to FIGS. 4 to 10, the shelf 100 may be mounted on the inner case 11 to align the pair of cold air communication holes 260 with the pair of cold air outlets 60 positioned at the rear (e.g., −X direction) of the shelf 100. The shelf 100 may include a switch 401 provided in a front opening 201 formed on a front surface 202.

The shelf 100 may include a shelf body 200 provided to support food so that the food is accommodated in the second refrigerating compartment 21*b*, and a shelf base 300 disposed below the shelf body 200. The shelf 100 may include the cold air control lever 400 disposed between the shelf body 200 and the shelf base 300 to open and close the first cold air communication hole 260*a* formed on a rear surface of the shelf body 200.

The cold air control lever 400 may slide between a first position P1 in which the first cold air communication hole 260*a* is opened and a second position P2 in which the first cold air communication hole 260*a* is closed, depending on a movement of the switch 401 sliding horizontally through the front opening 201 of the shelf body 200. The first position P1 and the second position P2 of the switch 401 may be symmetrical to each other with respect to a center line of the shelf 100 in a front-rear direction (e.g., X direction).

The pair of cold air communication holes 260 may be formed at symmetrical positions with respect to the center line of the shelf 100 in the front-rear direction (e.g., X direction). The cold air communication hole 260 may be formed on a second rear wall 200*f* of the shelf body 200. A rear rib 360 may be provided below the cold air communication hole 260 (e.g., −Z direction).

A guide hole 321 may be provided at an inner side of a bottom surface 310*g* of the shelf base 300 so that a position where the shelf base 300 and the shelf body 200 are coupled may be detected from the outside. A plurality of the guide holes 321 may be provided as shown in the drawing.

Figure 39:
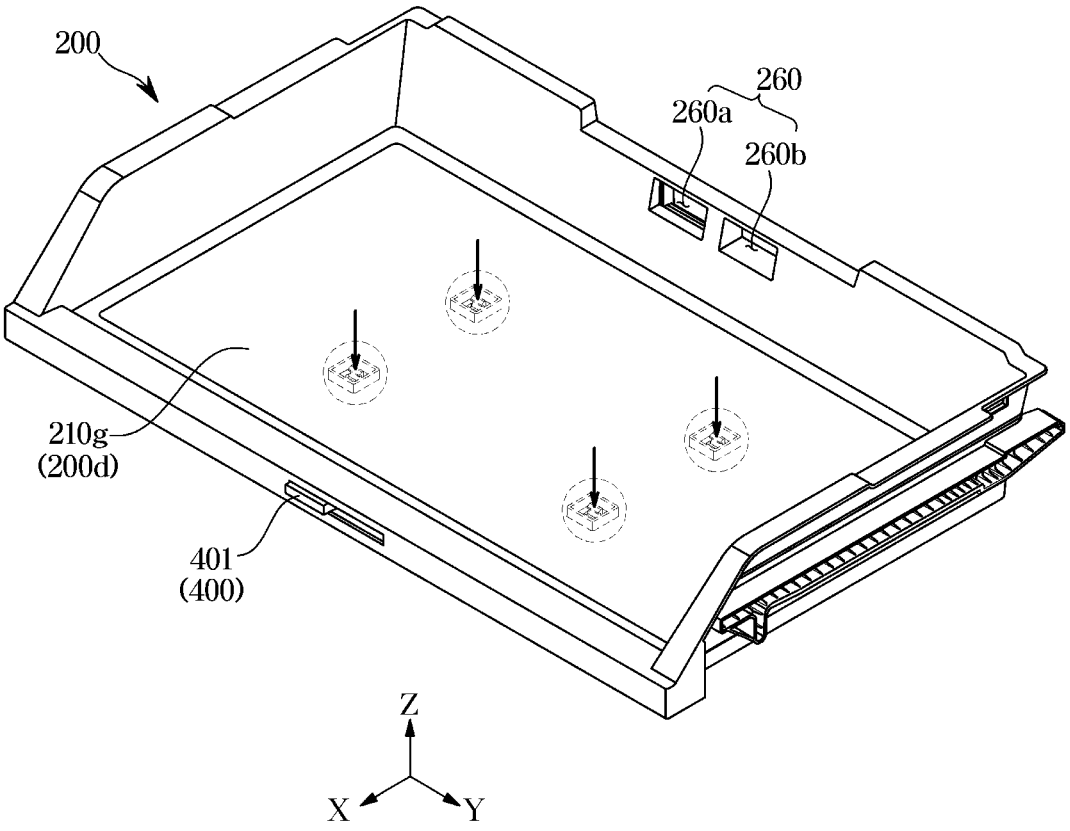

The shelf body 200 may include the front surface 202 having a front opening 201, and a front wall 203. The shelf body 200 may include a support wall 200*d* supporting food. The support wall 200*d* may include a support surface 210*g* (see FIG. 39) and a bottom surface 210*d*.

The shelf body 200 may include a left wall 200*b* positioned on the left side of the support wall 200*d*, a right wall 200*c* positioned on the right side of the support wall 200*d*, and a first rear wall 200*e* positioned at the rear of the support wall 200*d*. The first rear wall 200*e* is provided as a pair and one thereof may be connected to the left wall 200*b* and the other one thereof may be connected to the right wall 200*c*. The pair of first rear walls 200*e* may be spaced apart from each other, and each of the first rear walls 200*e* may be connected to a second rear wall 200*f* connected to the first rear wall 200*e*.

The shelf body 200 may include a front inner surface 210*a*, a left inner surface 210*b*, a right inner surface 210*c*, and a rear inner surface 210*e*, with respect to the bottom surface 210*d*.

The shelf base 300 may include a front surface 302 on which the switch 401 is supported and a guide wall 303. The shelf base 300 may include a bottom wall 300*d* supporting the cold air control lever 400, a left wall 300*b* positioned on the left side of the bottom wall 300*d*, a right wall 300*c* positioned on the right side of the bottom wall 300*d*, and a first rear wall 300*e* positioned at the rear of the bottom wall 300*d*. The shelf base 300 may further include a second rear wall 300*f* protruding rearward from the first rear wall 300*e*.

The shelf body 200 may include a plurality of coupling protrusions 211, 212, 213, and 215 formed along an edge around the bottom surface 210*d*. The plurality of coupling protrusions 211, 212, 213, and 215 may be a configuration for being coupled to the shelf base 300. The shelf body 200 may include the front coupling protrusion 211 protruding rearward from the front inner surface 210*a*, the left coupling protrusions 212 provided on the left inner surface 210*b* and the right inner surface 210*c* so as to face each other, respectively, and the right coupling protrusion 213. A rear groove 214 formed on the rear inner surface 210*e* and the rear coupling protrusions 215 formed on surfaces facing each other by being bent from the rear inner surface 210*e* may be provided at the rear of the bottom surface 210*d*.

Figure 37:
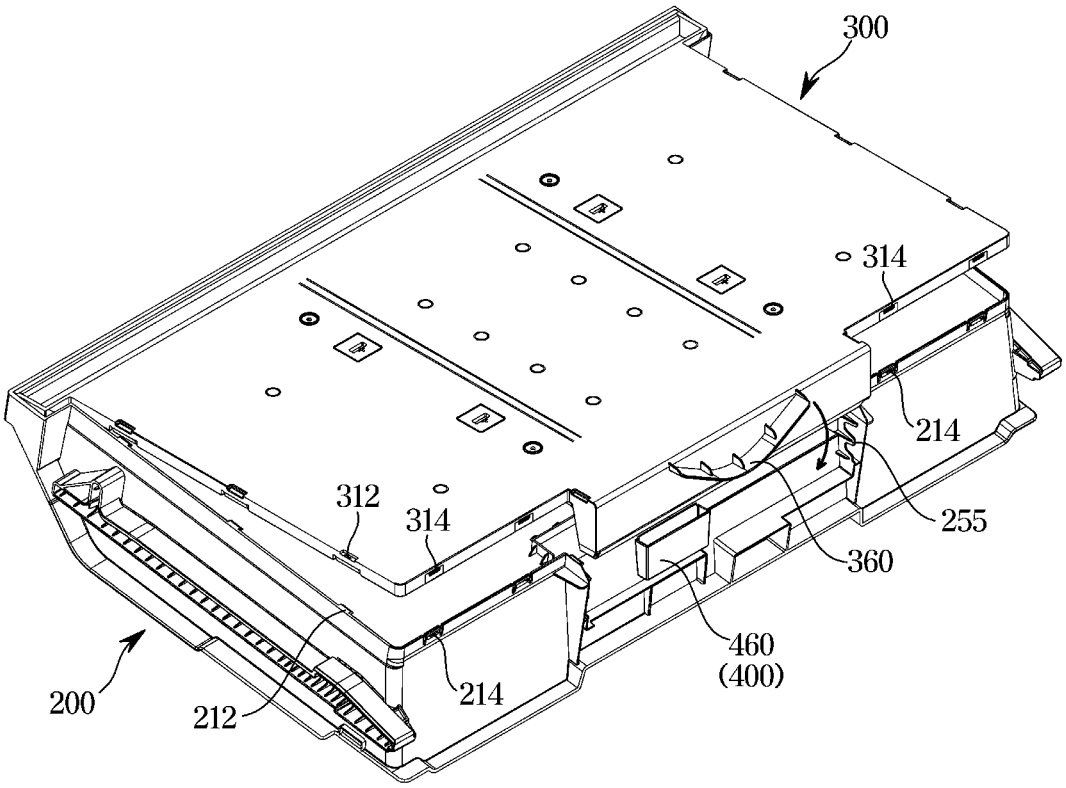
Figure 38:
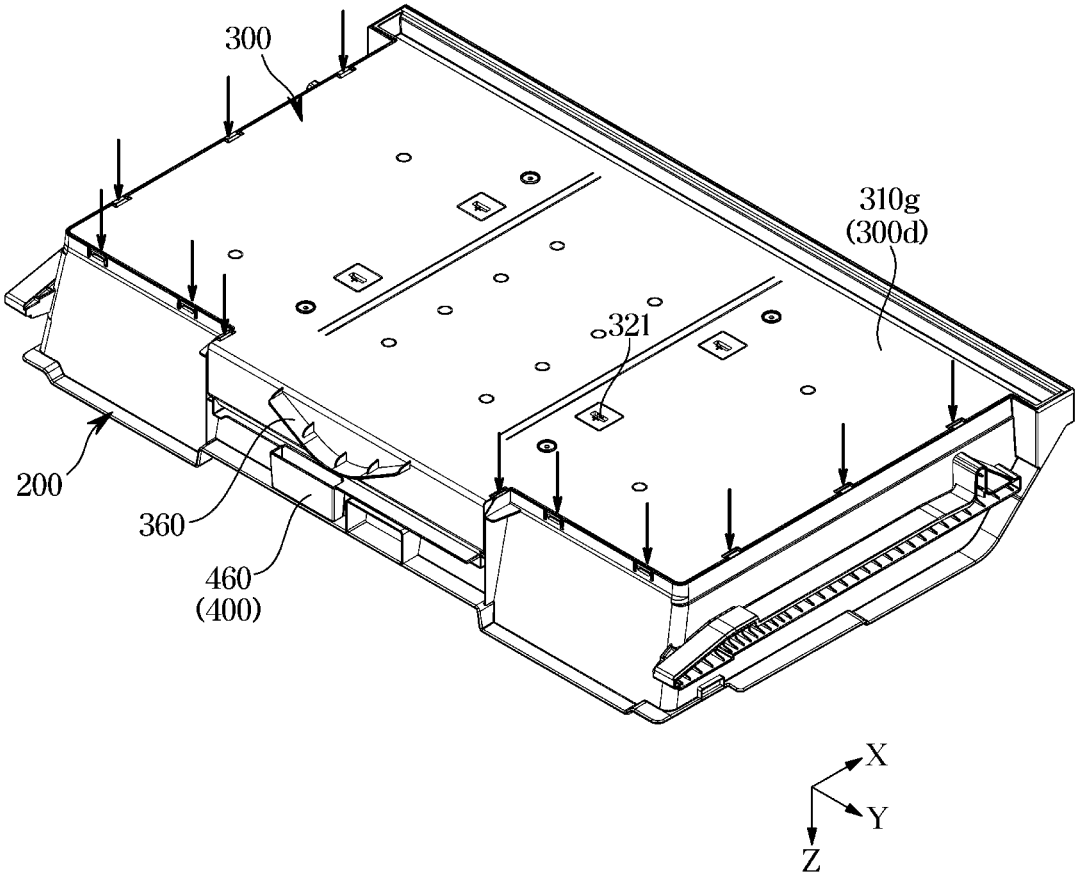

The front coupling protrusion 211 (see FIG. 26) may be inserted into a front coupling groove 311 formed on the guide wall 303 of the shelf base 300. The left coupling protrusion 212 and the right coupling protrusion 213 may be inserted into a left coupling groove 312 (see FIG. 37) and a right coupling groove 313 formed on the left wall 300*b* and the right wall 300*c* of the shelf base 300, respectively.

A rear protrusion 314 of the shelf base 300 may be inserted into the rear groove 214 of the shelf body 200, and the rear coupling protrusion 215 of the shelf body 200 may be inserted into a rear coupling groove 315 of the shelf base 300.

A pair of guide ribs 235 protruding toward the shelf base 300 and extending in a moving direction of the cold air control lever 400 to guide a movement of the cold air control lever 400 may be provided on the bottom surface 210*d* of the shelf body 200.

An insertion rib 240 extending in the front-rear direction (e.g., X direction) may be provided on the bottom surface 210*d* of the shelf body 200. The shelf body 200 may include an interference protrusion 220 protruding toward the shelf base 300 to be hooked to a hook protrusion 320 of the shelf base 300 from the bottom surface 210*d*.

A cover rib 250 may be provided at the rear of the bottom surface 210*d* of the shelf body 200 to prevent the cold air introduced through the cold air outlet 60 from moving between the shelf body 200 and the shelf base 300.

The hook protrusion 320 may be provided on a base surface 310*d* of the shelf base 300 to be hooked to the interference protrusion 220. The shelf base 300 may include a support rib 340 protruding from the base surface 310*d* toward the shelf body 200 and extending in the front-rear direction (e.g., X direction). The support rib 340 may be a configuration for supporting the shelf body 200. A pair of the support ribs 340 may be provided to form an insertion groove 340*a*, and a plurality of the insertion grooves 340*a* may be provided.

A stopper 350 may be provided on the base surface 310*d* to prevent the cold air control lever 400 located at the first position P1 and the second position P2 from moving to one side.

As illustrated in FIGS. 9 and 10, the shelf base 300 may include a pair of interference ribs 305 formed on the front surface 302 and protruding forward (e.g., +X direction). The shelf base 300 may also include the rear rib 360 formed on a rear surface 310*f*.

The shelf base 300 may include a guide extension part 327 provided on the rear of the guide wall 303. The guide extension part 327 may guide a movement of a guide protrusion 428 of the cold air control lever 400, which will be described later.

Figure 11:
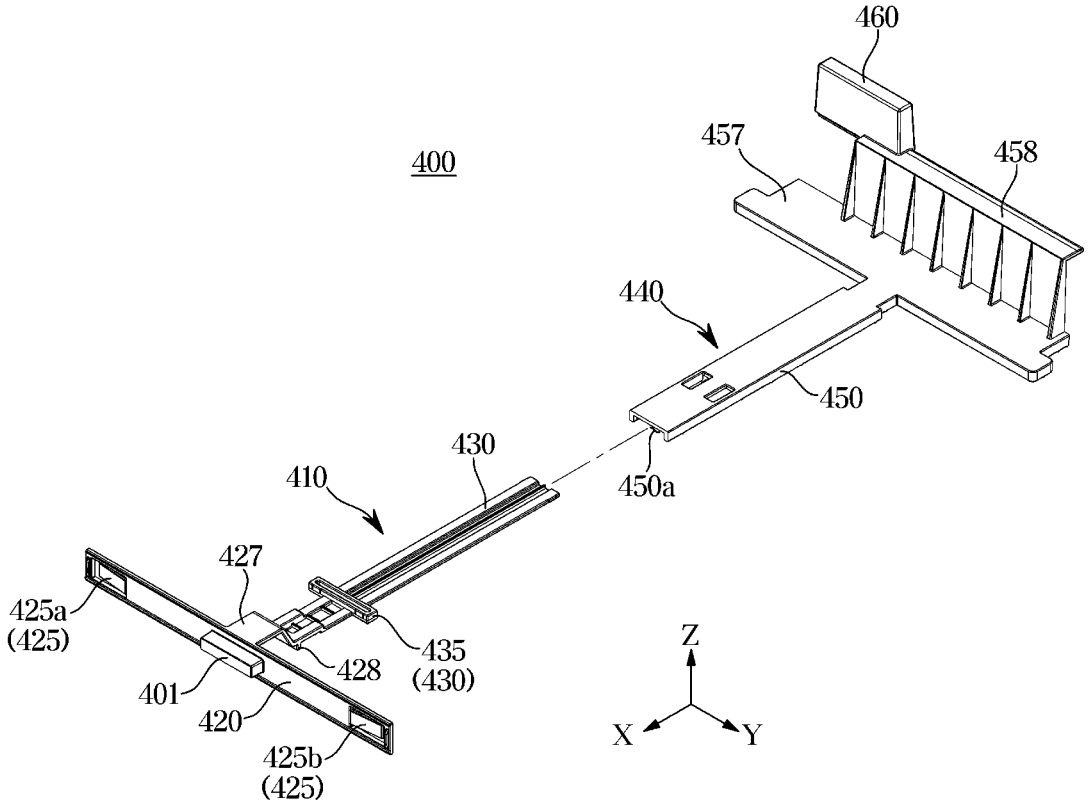
FIG. 11 is an exploded perspective view of a cold air control lever according to an embodiment of the present disclosure.
Figure 12:
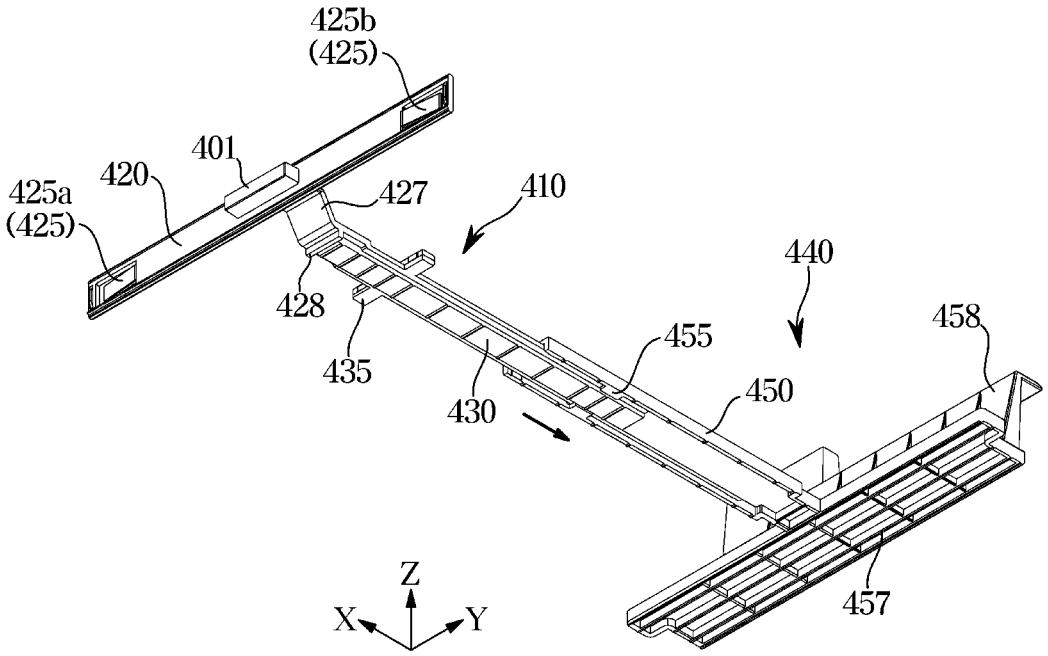
FIGS. 12 and 13 are bottom perspective views of a cold air control lever whose length is adjusted according to an embodiment of the present disclosure.
Figure 13:
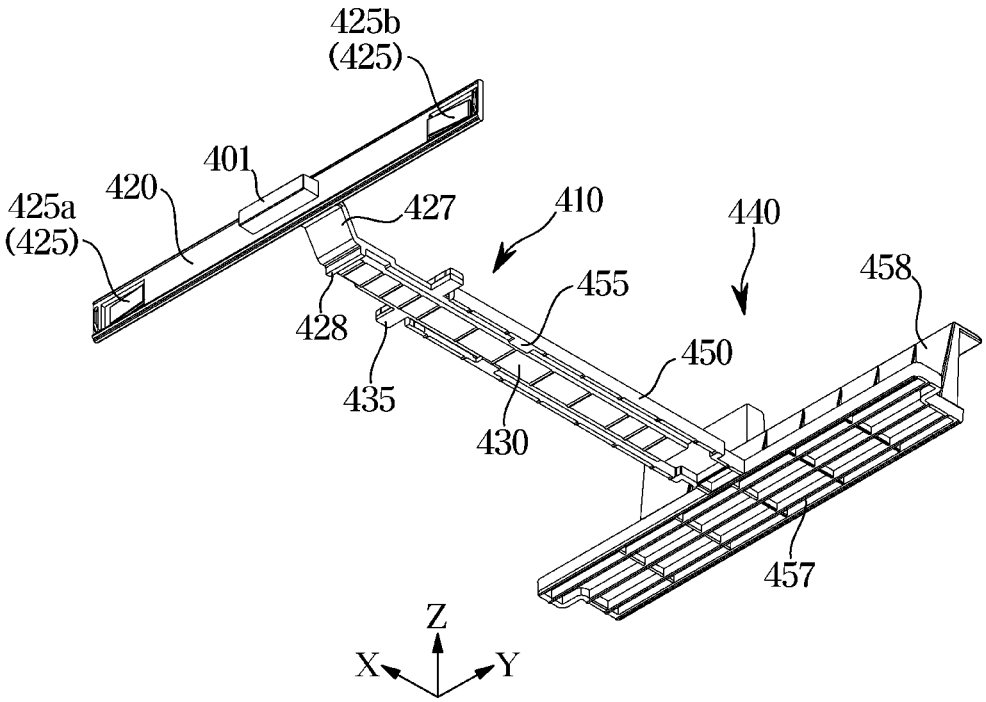

FIG. 11 is an exploded perspective view of a cold air control lever according to an embodiment of the present disclosure. FIGS. 12 and 13 are bottom perspective views of a cold air control lever whose length is adjusted according to an embodiment of the present disclosure.

Referring to FIGS. 11 to 13, the cold air control lever 400 may include a first cold air control lever 410 including the switch 401, and a second cold air control lever 440 disposed on the rear of the first cold air control lever 410 and including an opening/closing part 460.

The first cold air control lever 410 may be moved in the horizontal direction (e.g., Y direction) by the movement of the switch 401, and the second cold air control lever 440 may be moved depending on a movement of the first cold air control lever 410 moved in the horizontal direction.

The first cold air control lever 410 may include a guide plate 420 connected to the switch 401, a seating part 427 disposed at the rear of the guide plate 420, and a connection part 430 bent from the seating part 427 and extending rearward.

The guide plate 420 may include a pair of elastic protrusions 425 provided on opposite sides. The seating part 427 may be seated on the guide wall 303 of the shelf base 300

(see FIG. 8). The connection part 430 may be a part supported by the base surface 310*d* of the shelf base 300 and coupled to the second cold air control lever 440.

The first cold air control lever 410 may include a guider 435 protruding from the connection part 430 in a moving direction (e.g., Y direction) of the first cold air control lever 410. The first cold air control lever 410 may include the guide protrusion 428 provided between the guider 435 and the seating part 427. The guide protrusion 428 may guide the movement of the first cold air control lever 410 in the horizontal direction by protruding from a bottom surface of the first cold air control lever 410 toward the shelf base 300 such that a front surface of the guide protrusion 428 comes into contact with the guide extension part 327 of the shelf base 300.

The second cold air control lever 440 may include an insertion hole 450*a* into which the connection part 430 of the first cold air control lever 410 is inserted. The second cold air control lever 440 may include a coupling part 450, a horizontal connection plate 457 disposed at the rear of the coupling part 450, and a vertical connection plate 458 vertically connected to the horizontal connection plate 457. The vertical connection plate 458 may extend vertically to the horizontal connection plate 457 to support the opening/closing part 460.

As illustrated in FIGS. 12 and 13, a length of the cold air control lever 400 may be adjusted in a front-rear direction (e.g., X direction) while the first cold air control lever 410 is inserted into the coupling part 450 through the insertion hole 450*a*. In order to adjust the length in the front-rear direction (e.g., X direction), the connection part 430 and the coupling part 450 are not coupled by a coupling member such as a screw, but the connection part 430 is supported by a supporter 455. With this structure, the cold air control lever 400 may be disposed on the shelves of the refrigerator 1 having various shapes, thereby increasing usefulness.

Figure 14:
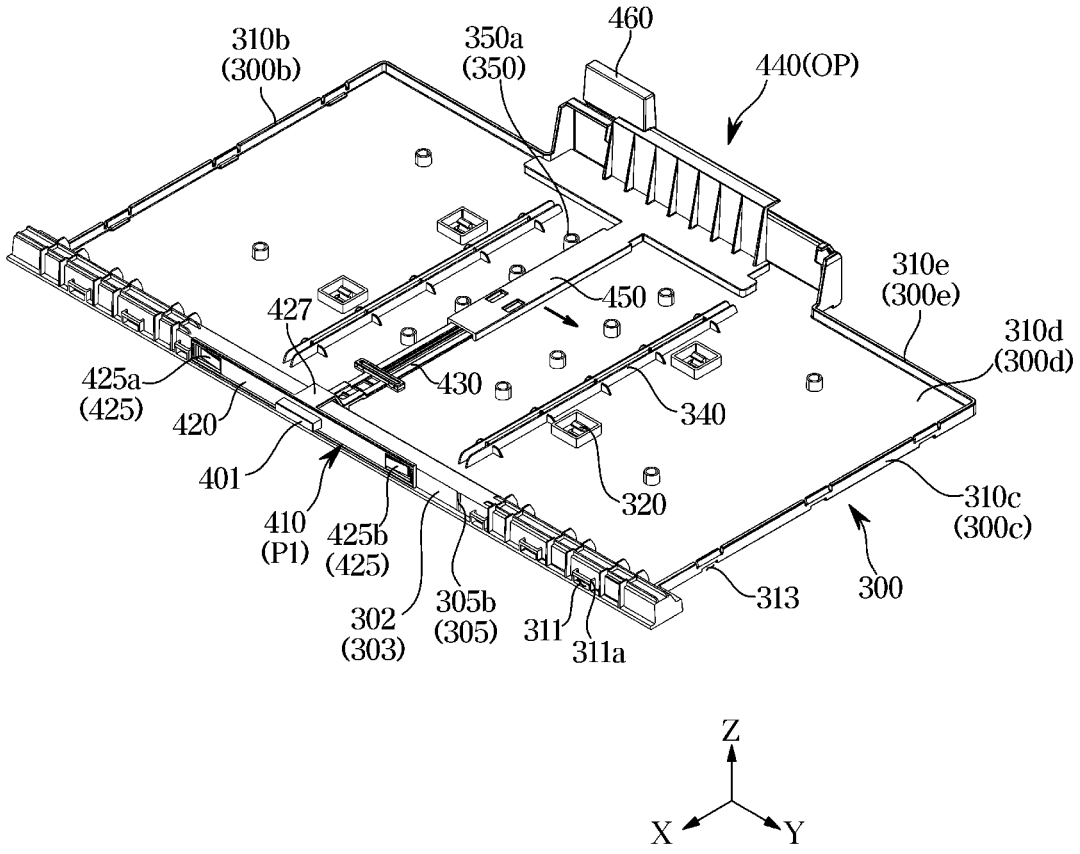
FIG. 14 is a perspective view of a cold air control lever seated on a shelf base and located in a first position according to an embodiment of the present disclosure.
Figure 15:
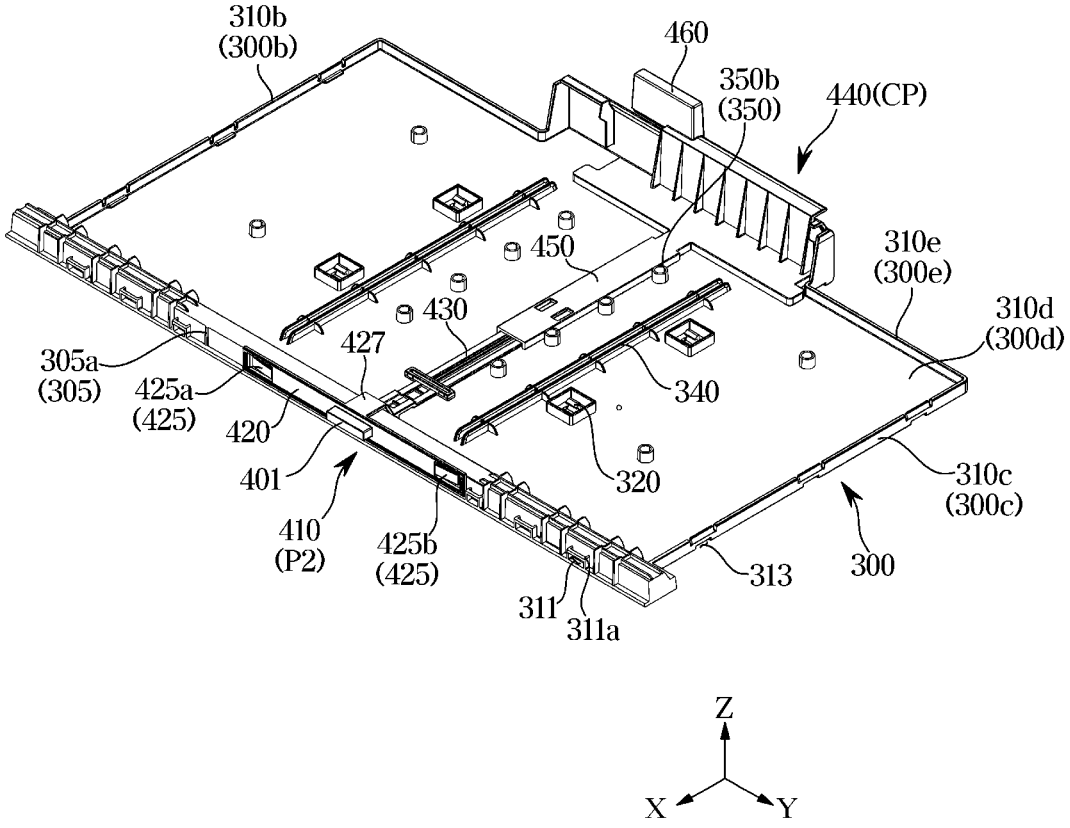
FIG. 15 is a perspective view of a cold air control lever seated on a shelf base and located in a second position according to an embodiment of the present disclosure.
Figure 16:
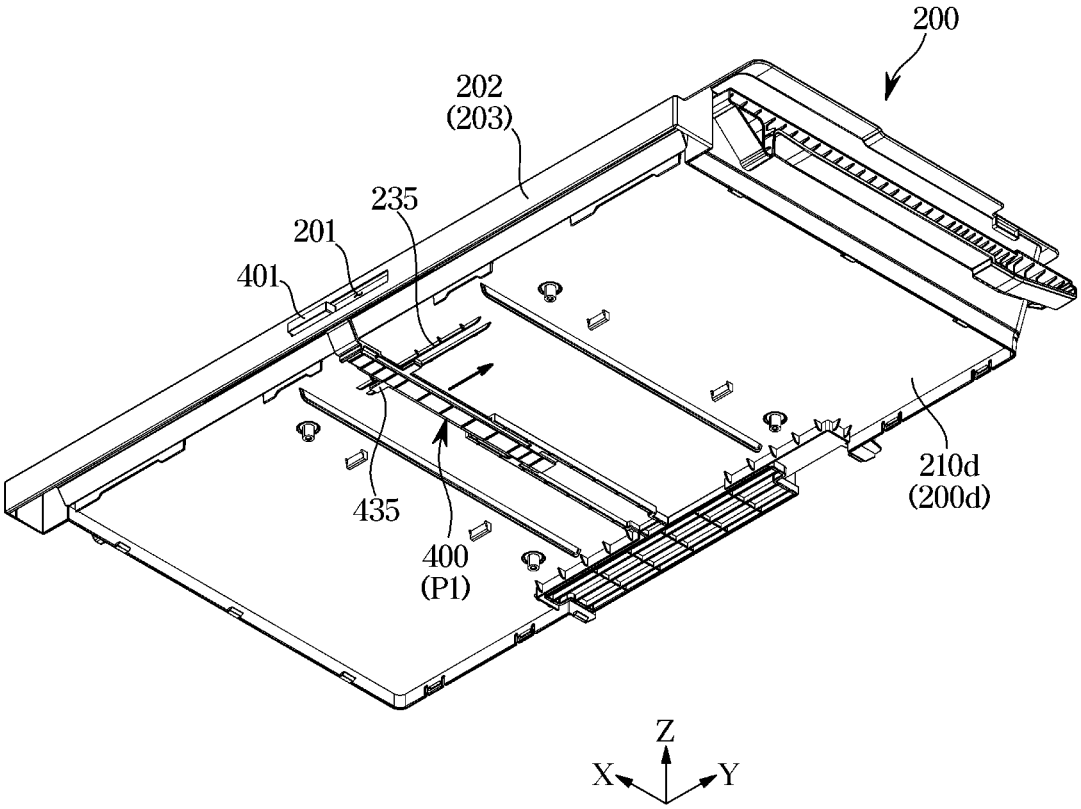
FIG. 16 is a bottom perspective view of a cold air control lever coupled to a shelf body and located in a first position according to an embodiment of the present disclosure.
Figure 17:
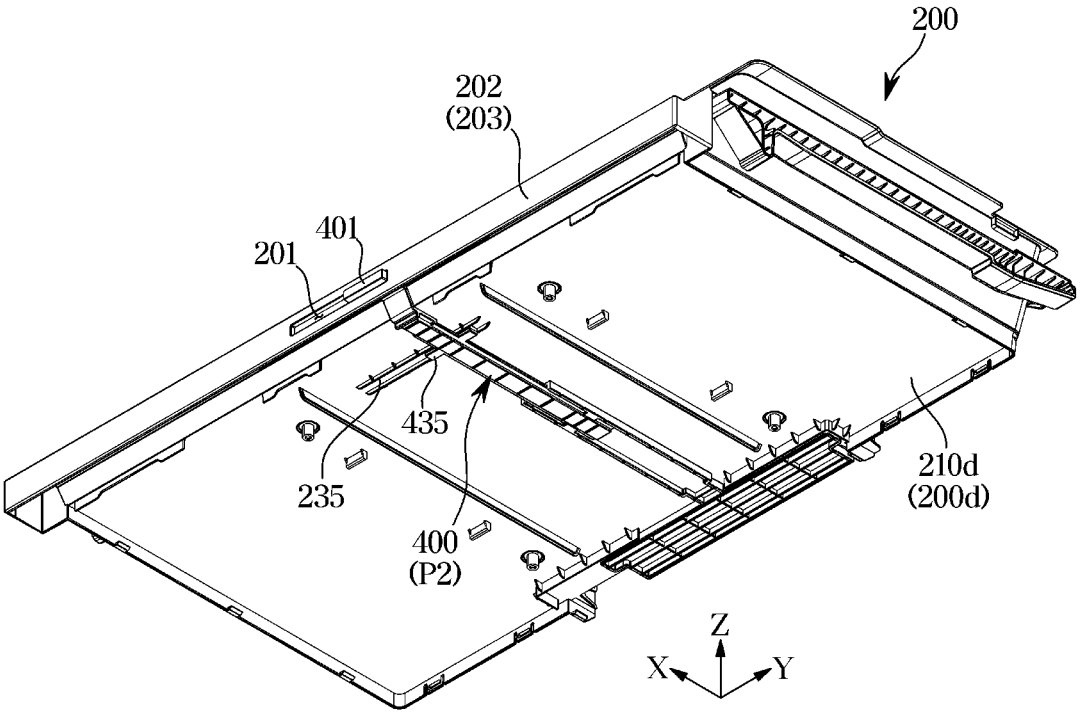
FIG. 17 is a bottom perspective view of a cold air control lever coupled to a shelf body and located in a second position according to an embodiment of the present disclosure.

FIG. 14 is a perspective view of a cold air control lever seated on a shelf base and located in a first position according to an embodiment of the present disclosure. FIG. 15 is a perspective view of a cold air control lever seated on a shelf base and located in a second position according to an embodiment of the present disclosure. FIG. 16 is a bottom perspective view of a cold air control lever coupled to a shelf body and located in a first position according to an embodiment of the present disclosure. FIG. 17 is a bottom perspective view of a cold air control lever coupled to a shelf body and located in a second position according to an embodiment of the present disclosure.

The cold air control lever 400 is movable between the first position P1 and the second position P2 by being seated on the shelf base 300 and moved between the first position P1 and the second position P2 by coming into contact with the shelf body 200, which movement will be described in detail below with reference to FIGS. 14 to 17.

When the cold air control lever 400 is in the first position P1, the second cold air control lever 440 may be located at an open position OP, and the coupling part 450 may come into contact with the right side of a first stopper 350*a*. Because a plurality of the first stoppers 350*a* protrudes from the base surface 310*d* and is arranged in the front-rear direction (e.g., X direction), the cold air control lever 400 may be prevented from moving to the left side (e.g., −Y direction) of the first stopper 350*a*.

The cold air control lever 400 may slide to the second position P2 depending on the movement of the switch 401 in the horizontal direction. At this time, the second cold air control lever 440 may be located in a closed position CP. When the second cold air control lever 440 is located in the closed position CP, the coupling part 450 may interfere with the left side of the second stopper 350*b*. Because the structure of the first stopper 350*a* is also applied to the second stopper 350*b* as described above, the cold air control lever 400 may be prevented from moving in the second position P2.

With this structure, unlike a structure in which the cold air control lever 400 interferes with the front opening 201 of the shelf body 200, a rear portion of the cold air control lever 400 may be slid only between the first position P1 and the second position P2 by interfering with the stopper 350.

In addition, because the seating part 427 of the cold air control lever 400 may be moved in the horizontal direction along the guide wall 303 of the shelf base 300, the movement of the first cold air control lever 410 may be guided.

Because one surface of the guide protrusion 428 of the cold air control lever 400 may be moved in the horizontal direction while coming into contact with the guide extension part 327 of the shelf base 300, the movement of the first cold air control lever 410 may be guided.

The cold air control lever 400 positioned below the shelf body 200 may be guided to be moved between the first position P1 and the second position P2 in the horizontal direction by the guide rib 235 provided on the bottom surface 210*d* of the shelf body 200.

More specifically, the cold air control lever 400 may include the guider 435 extending from the connection part 430 (see FIG. 11) in a moving direction of the first cold air control lever 410. The guide ribs 235 may be spaced apart by a width of the guider 435 to come into contact with front and rear ends of the guider 435. In order to have this structure, the guide ribs 235 may be provided as a pair spaced apart in the front-rear direction. The guide rib 235 may extend along a longitudinal direction (e.g., Y direction) of the front opening 201 of the shelf body 200 in the horizontal direction, and may be provided to be longer than a length between a left end of the guider 435 of the cold air control lever 400 located at the first position P1 and a right end of the guider 435 of the cold air control lever 400 located at the second position P2.

With this structure, because a movement in the horizontal direction below the cold air control lever 400 disposed between the shelf base 300 and the shelf body 200 is guided by the guide wall 303, and at the same time a movement of the guider 435 above the cold air control lever 400 is guided by the guide rib 235, the movement of the cold air control lever 400 may be guided.

Figure 18:
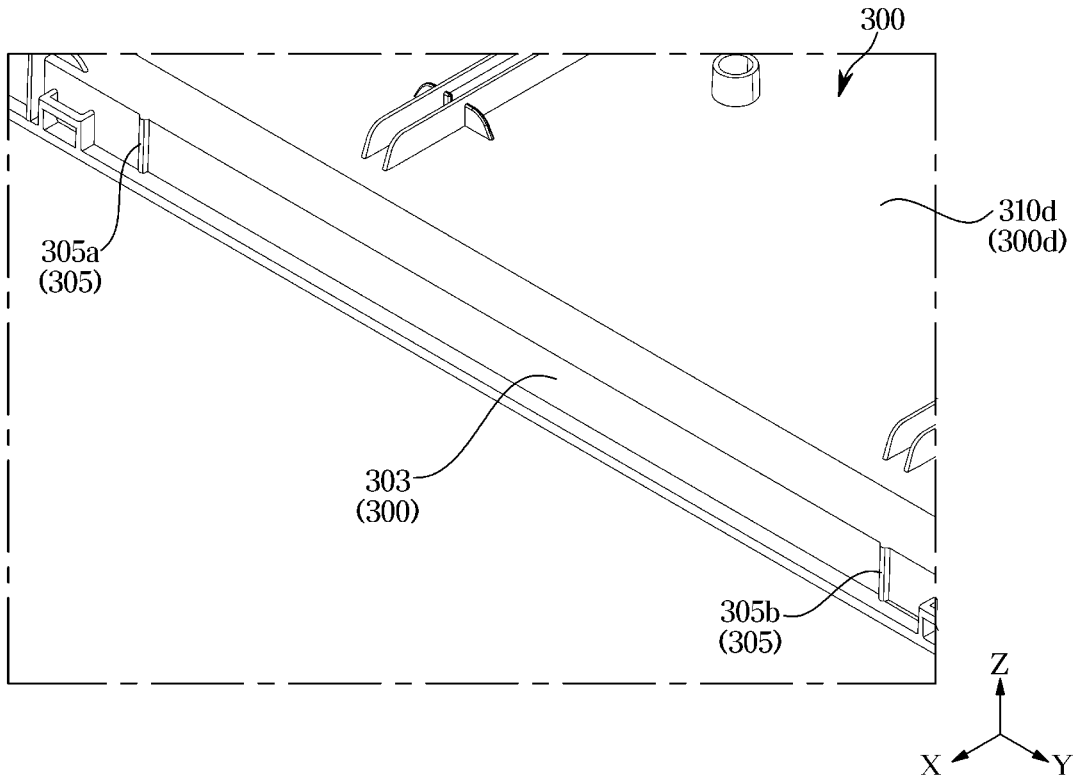
FIG. 18 is an enlarged view of area F shown in FIG. 9.
Figure 19:
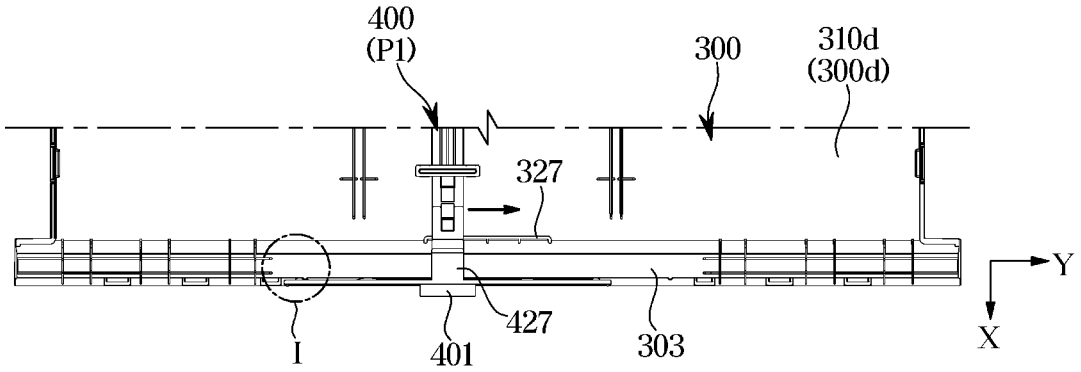
FIG. 19 is a top view of a first cold air control lever located in a first position and a shelf base according to an embodiment of the present disclosure.
Figure 20:
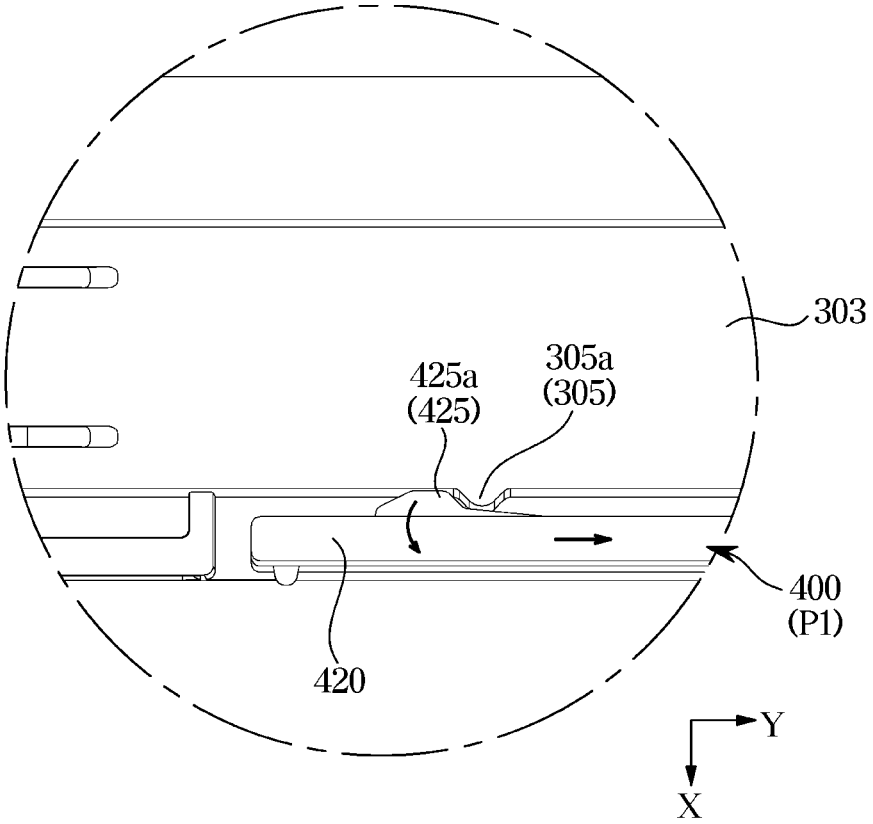
FIG. 20 is an enlarged view of area I shown in FIG. 19.
Figure 21:
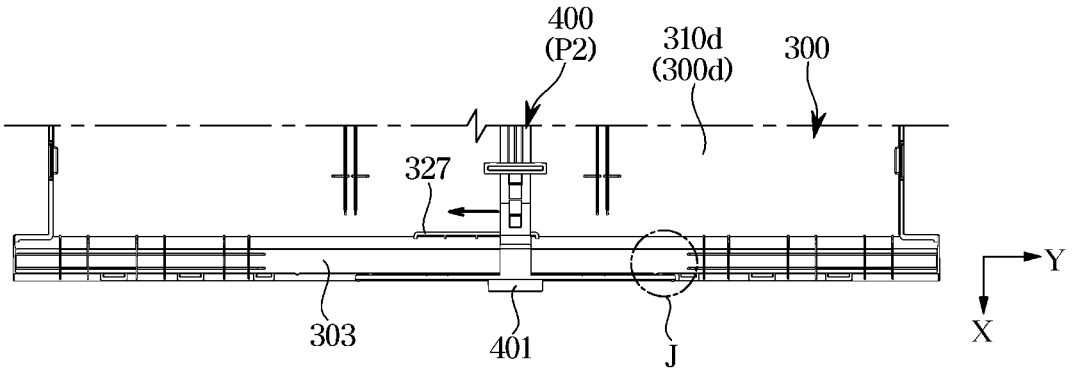
FIG. 21 is a top view of a first cold air control lever located in a second position and a shelf base according to an embodiment of the present disclosure.
Figure 22:
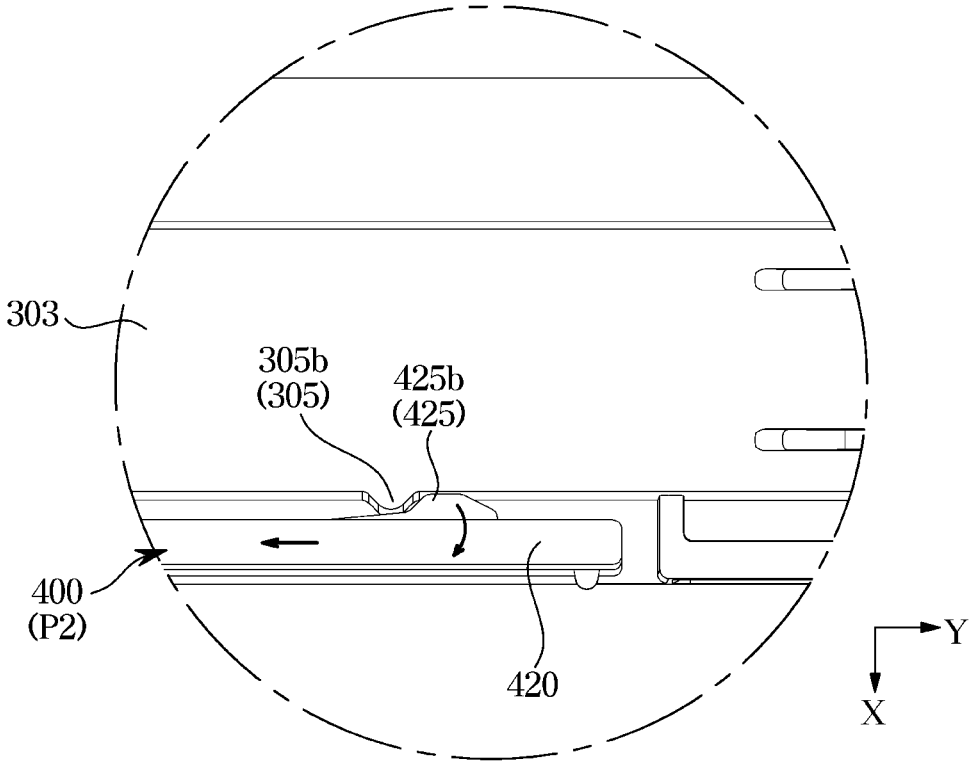
FIG. 22 is an enlarged view of area J shown in FIG. 21.

FIG. 18 is an enlarged view of area F shown in FIG. 9. FIG. 19 is a top view of a first cold air control lever located in a first position and a shelf base according to an embodiment of the present disclosure. FIG. 20 is an enlarged view of area I shown in FIG. 19. FIG. 21 is a top view of a first cold air control lever located in a second position and a shelf base according to an embodiment of the present disclosure. FIG. 22 is an enlarged view of area J shown in FIG. 21.

Referring to FIGS. 18 to 22, in addition to the structure in which the switch 401 interferes with the front opening 201 shown in FIG. 4, the cold air control lever 400 may require a structure for a user to detect that the cold air control lever 400 is in the first position P1 or the second position P2.

The pair of interference ribs 305 protruding forward (e.g., +X direction) may be provided on the guide wall 303 of the shelf base 300. The pair of interference ribs 305 may be ribs protruding toward the guide plate 420 to be caught on the elastic protrusions 425 of the guide plate 420 of the cold air control lever 400.

Because the cold air control lever 400 is moved between the first position P1 and the second position P2 while the seating part 427 is supported by the guide wall 303, the guide plate 420 may be moved between the first position P1 and the second position P2 to face the front surface 302 of the shelf base 300.

The guide plate 420 may be provided with the elastic protrusions 425 positioned on the opposite sides. The elastic protrusion 425 may be provided as a pair, and may include a first elastic protrusion 425*a* positioned on one side of the guide plate 420 and a second elastic protrusion 425*b* positioned on the other side of the guide plate 420.

The interference rib 305 may include a first interference rib 305*a* formed to interfere with the first elastic protrusion 425*a* and a second interference rib 305*b* formed to interfere with the second elastic protrusion 425*b*.

One end of each of the elastic protrusions 425 may be connected to the guide plate 420 and the other end thereof may be separated from the guide plate 420 without being coupled. In this structure, the other end of the elastic protrusion 425 may be in a rotatable state while the one end connected to the guide plate 420 is fixed.

As illustrated in FIG. 20, as the cold air control lever 400 located at the first position P1 is moved to the second position P2 by the switch 401, the first elastic protrusion 425*a* may interfere with the first interference rib 305*a*. The other end of the first elastic protrusion 425*a* interfering with the first interference rib 305*a* may rotate about one end thereof. With this structure, the user may sense that the cold air control lever 400 is moved from the first position P1 when moving the cold air control lever 400 from the first position P1 to the second position P2 using the switch 401.

The other end of the first elastic protrusion 425*a* may be rotated by the first interference rib 305*a*, the first elastic protrusion 425*a* may return to an original position thereof when the guide plate 420 is further moved in one direction (e.g., Y direction).

When the switch 401 is moved from the first position P1 toward the second position P2 and reaches a position adjacent to the second position P2, one end of the second elastic protrusion 425*b* may be rotated by interfering with the second interference rib 305*b*. With this structure, the user may recognize that the cold air control lever 400 has reached a position adjacent to the second position P2.

As illustrated in FIG. 22, there may be a case in which the user moves the cold air control lever 400 located at the second position P2 in one direction (e.g., −Y direction) in order to open the first cold air communication hole 260*a*.

The other end of the second elastic protrusion 425*b* of the cold air control lever 400 located at the second position P2 may be rotated by interfering with the second interference rib 305*b* protruding forward as the switch 401 is moved, and then return to an original position thereof after passing the second interference rib 305*b*. With this structure, as described above, the user may recognize that the cold air control lever 400 located at the second position P2 is moved.

On the other hand, even when the cold air control lever 400 is moved to the first position P1, the first elastic protrusion 425*a* may be moved from one side of the first interference rib 305*a* and interfere with the first interference rib 305*a*. The cold air control lever 400 located at the first position P1 needs to stop moving to the one side (e.g., −Y direction) in a state in which the opening/closing part 460 completely opens the first cold air communication hole 260*a*, and in this case, as the first elastic protrusion 425*a* interferes with the first interference rib 305*a*, the user may sense the interference.

Figure 23:
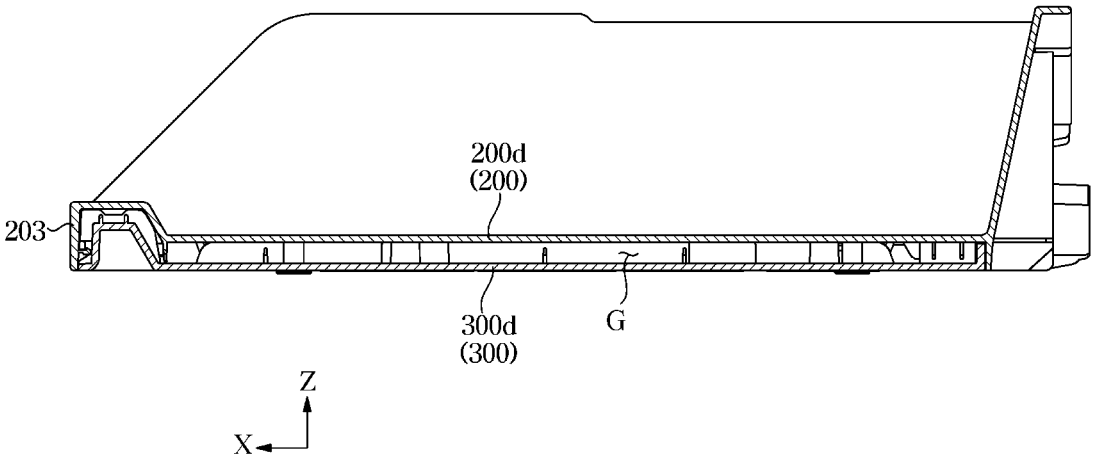
FIG. 23 is a side cross-sectional view of a shelf according to an embodiment of the present disclosure.
Figure 24:
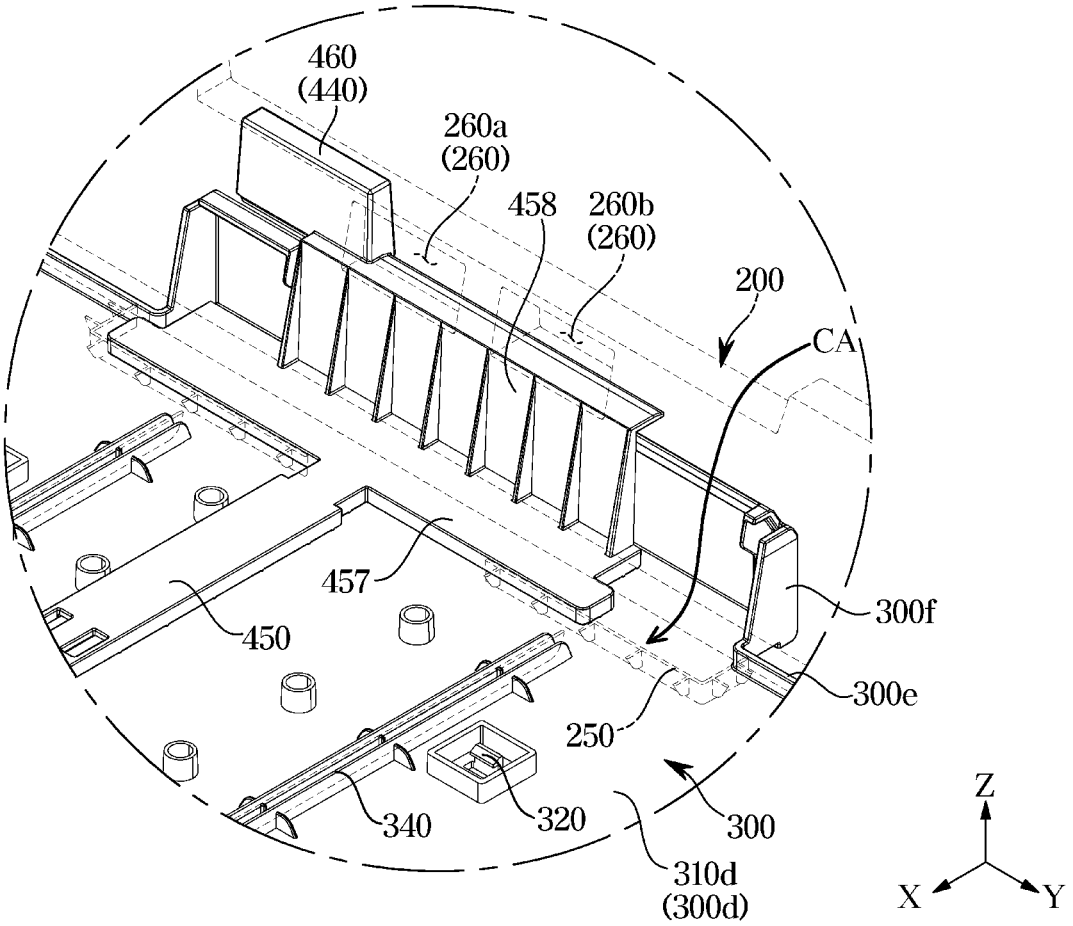
FIG. 24 is an enlarged view of a cover rib provided on a lower surface of a shelf body according to an embodiment of the present disclosure.
Figure 25:
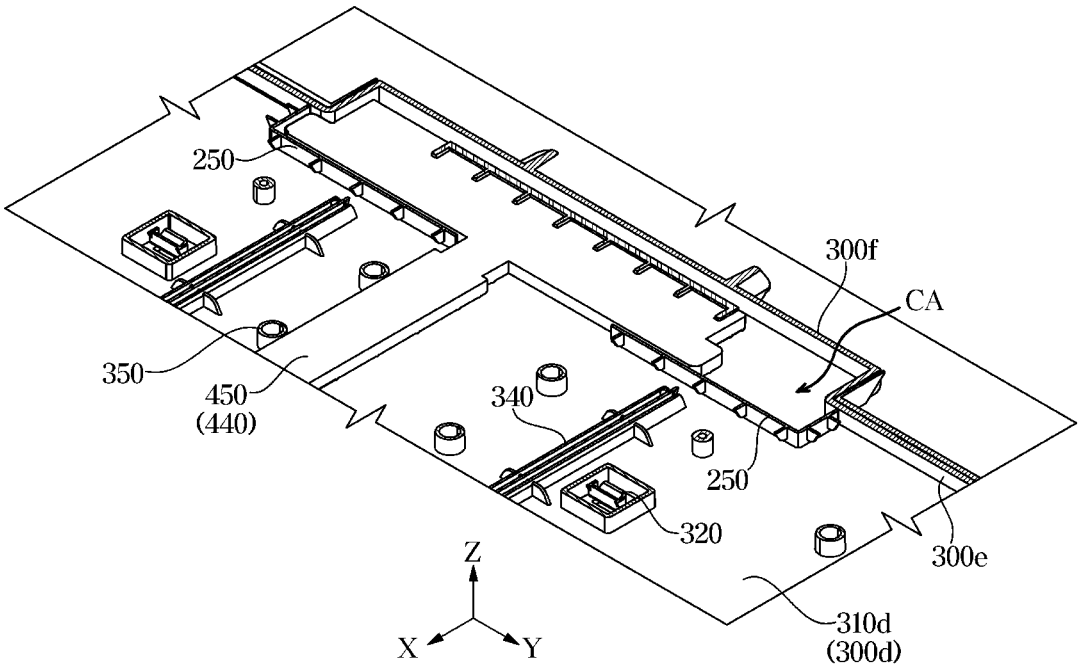
FIG. 25 is a cross-sectional perspective view of a cover rib and a shelf base according to an embodiment of the present disclosure.

FIG. 23 is a side cross-sectional view of a shelf according to an embodiment of the present disclosure. FIG. 24 is an enlarged view of a cover rib provided on a lower surface of a shelf body according to an embodiment of the present disclosure. FIG. 25 is a cross-sectional perspective view of a cover rib and a shelf base according to an embodiment of the present disclosure.

Referring to FIGS. 23 to 25, in the shelf 100, the shelf body 200 and the shelf base 300 may be coupled to each other in a state in which the shelf base 300 is disposed below the shelf body 200 so that the support wall 200*d* of the shelf body 200 and the bottom wall 300*d* of the shelf base 300 are separated from each other. The bottom wall 300*d* may cover a lower side of the support wall 200*d*. The support wall 200*d* may cover the bottom wall 300*d*. The support wall 200*d* and the bottom wall 300*d* may be disposed parallel to each other to form a gap G. Air may be accommodated in the gap G.

With this structure, as illustrated in FIG. 2, the second refrigerating compartment 21*b* partitioned by the shelf 100 and the shelf cover 110 may be maintained at a temperature lower than that of the first refrigerating compartment 21*a* by about 1 degree Celsius or more. The second refrigerating compartment 21*b*, which is a space partitioned separately from the first refrigerating compartment 21*a*, may store food different from food stored in the first refrigerating compartment 21*a* depending on user preference. This may be because the shelf cover 110 prevents cold air in the second refrigerating compartment 21*b* from leaking into the first refrigerating compartment 21*a*.

Even when food accommodated in the second refrigerating compartment 21*b* is stored depending on the user preference, the temperature of the second refrigerating compartment 21*b* may need to be controlled even when the temperature of the entire refrigerating compartment 21 is not controlled. That is, by moving the cold air control lever 400, the user may adjust an amount of cold air introduced into the second refrigerating compartment 21*b* through the first cold air communication hole 260*a* by completely opening, completely closing, or partially opening the first cold air communication port 260*a*.

That is, because cold air may be introduced into the second refrigerating compartment 21*b* through the open portion of the first cold air communication hole 260*a* and the second cold air communication hole 260*b*, the user may independently control the temperature of the second refrigerating compartment 21*b* using the cold air control lever 400 even without controlling the entire temperature of the refrigerating compartment 21.

Even when cold air to be introduced into the second refrigerating compartment 21*b* is controlled, a space in the second refrigerating compartment 21*b* adjacent to the first refrigerating compartment 21*a* may be affected by the first refrigerating compartment 21*a*. In order to prevent this, the shelf 100 may include an insulating space by leaving the gap G between the shelf body 200 and the shelf base 300.

More specifically, the shelf 100 may provide a separation space (e.g., the gap G) between the support wall 200*d* of the shelf body 200 and the bottom wall 300*d* of the shelf base 300 to insulate the second refrigerating compartment 21*b* from the first refrigerating compartment 21*a* through air accommodated in the gap G. With this structure, because the second refrigerating compartment 21*b* is adjacent to the first refrigerating compartment 21*a* but may have a relatively independent space, a temperature in the second refrigerating chamber 21*b* may be separately maintained, thereby improving user satisfaction.

Referring to FIGS. 24 and 25, the cold air communication hole 260 positioned at the rear of the shelf 100 may be a configuration for guiding the cold air discharged from the cold air outlet 60 of the refrigerating compartment cold air duct 50 (see FIG. 2) to the second refrigerating compartment 21*b* of the shelf 100.

In addition, the cold air discharged from the cold air outlet 60 may flow not only through the cold air communication hole 260 but also into the first refrigerating compartment 21*a* positioned below the second refrigerating compartment 21*b* (e.g., −Z direction). With this structure, a part of the cold air may be introduced between the shelf body 200 and the shelf base 300 through a space in which the opening/closing part 460 of the cold air control lever 400 is moved (CA direction in FIG. 24).

Accordingly, because cold air may be introduced into the gap G, which is a separation space between the shelf body 200 and the shelf base 300 described above, the second refrigerating compartment 21*b* may be easily affected by a temperature from an adjacent part of the second refrigerating compartment 21*b*.

In order to prevent this, the shelf body 200 may include the cover rib 250 protruding toward the shelf base 300 from the bottom surface 210*d*. The cover rib 250 may cover between the shelf body 200 and the shelf base 300. Because the cover rib 250 may prevent the flow of cold air (CA direction in FIG. 24) from being introduced between the shelf body 200 and the shelf base 300, the insulation structure of the shelf 100 may be maintained as it is.

The cover rib 250 may extend to surround the horizontal connection plate 457, extend to be in contact with the first rear wall 300*e* of the shelf base 300 disposed on both sides to prevent the movement of the cold air control lever 400 located at the first position P1 and the cold air control lever 400 located at the second position P2, and be provided as a pair spaced apart from each other so as not to interfere with the coupling part 450.

In this structure, the cold air discharged through the cold air outlet 60 may be prevented from being introduced between the shelf body 200 and the shelf base 300 by the second cold air control lever 440 or the cover rib 250.

Figure 26:
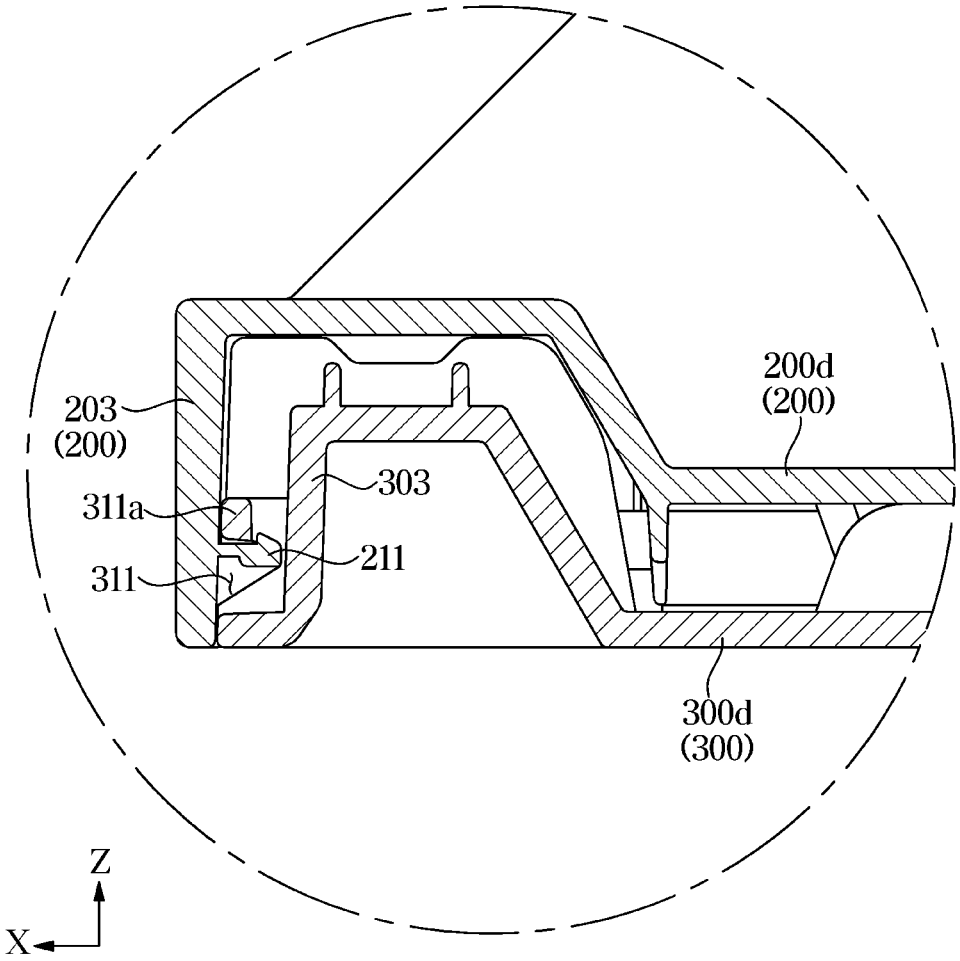
FIG. 26 is an enlarged cross-sectional view taken along line A-A' shown in FIG. 4.
Figure 27:
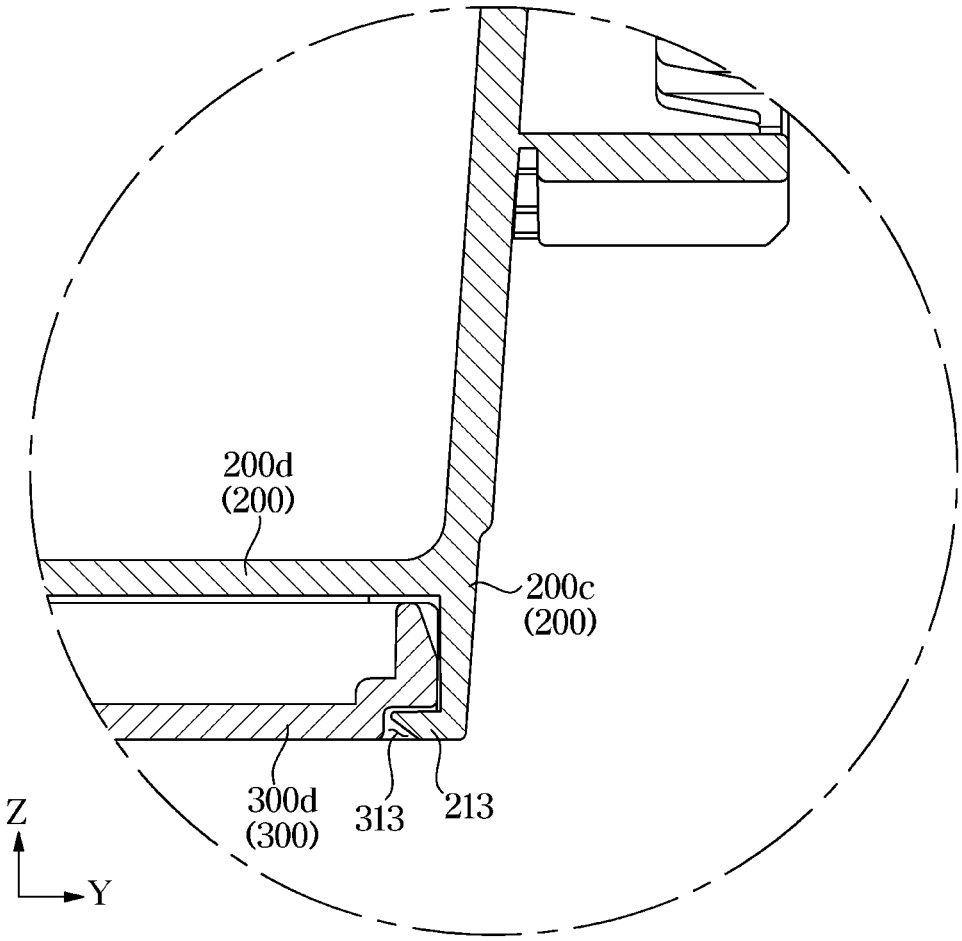
FIG. 27 is a cross-sectional view taken along line B-B' shown in FIG. 4.
Figure 28:
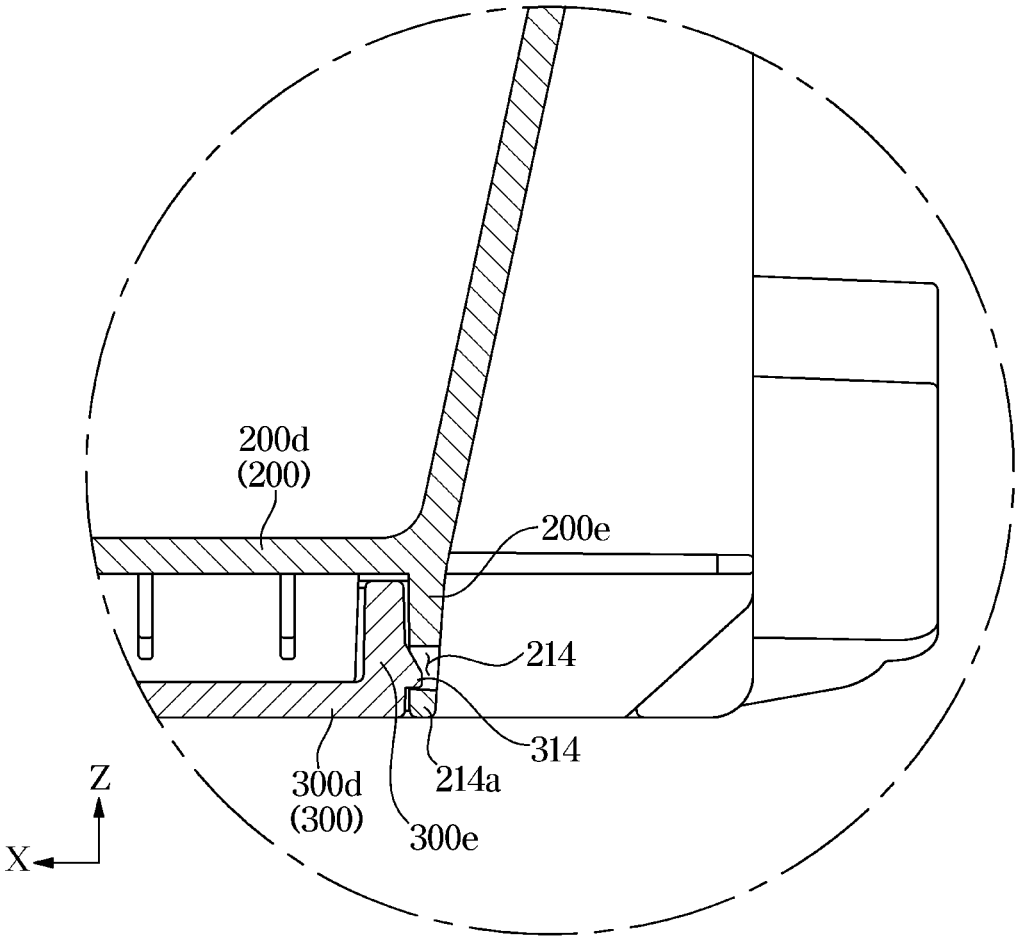
FIG. 28 is a cross-sectional view taken along line D-D' shown in FIG. 4.
Figure 29:
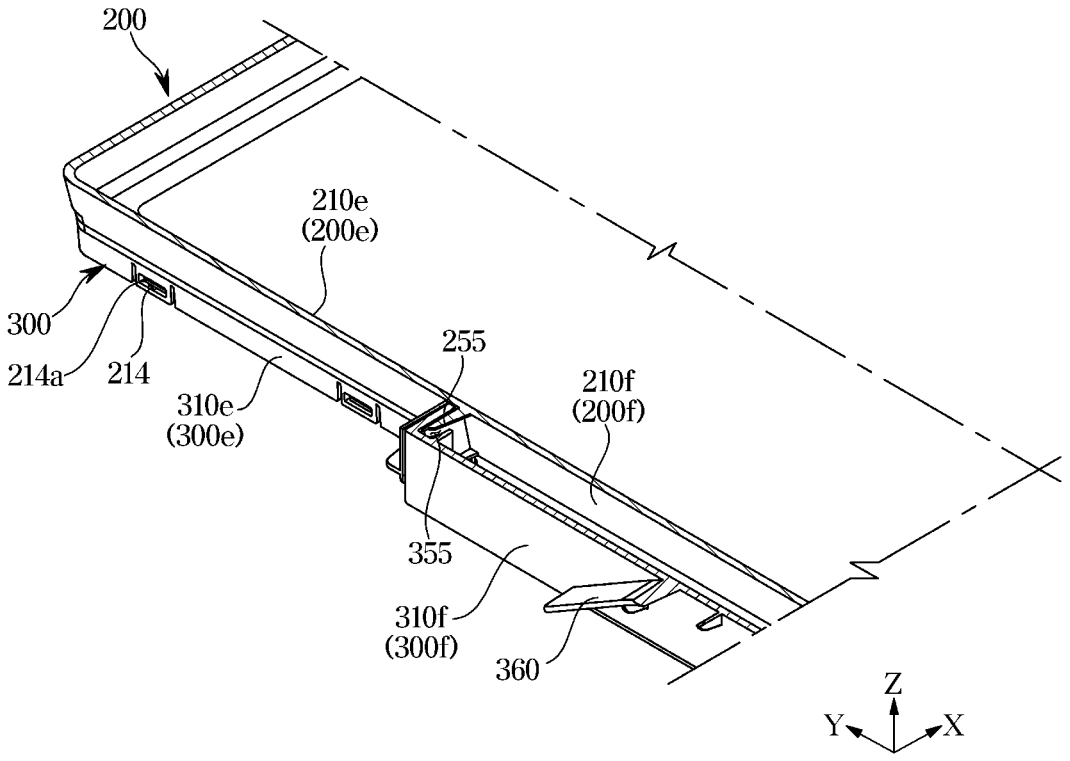
FIG. 29 is a cross-sectional perspective view illustrating a combination of a shelf body and a shelf base according to an embodiment of the present disclosure from the rear.
Figure 30:
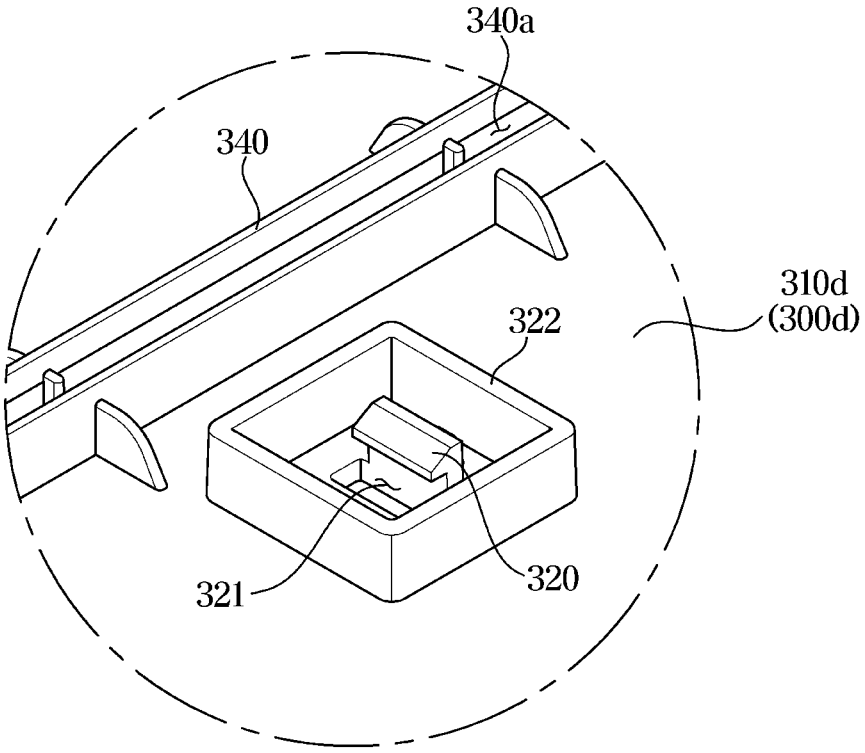
FIG. 30 is an enlarged view of area E shown in FIG. 8.
Figure 31:
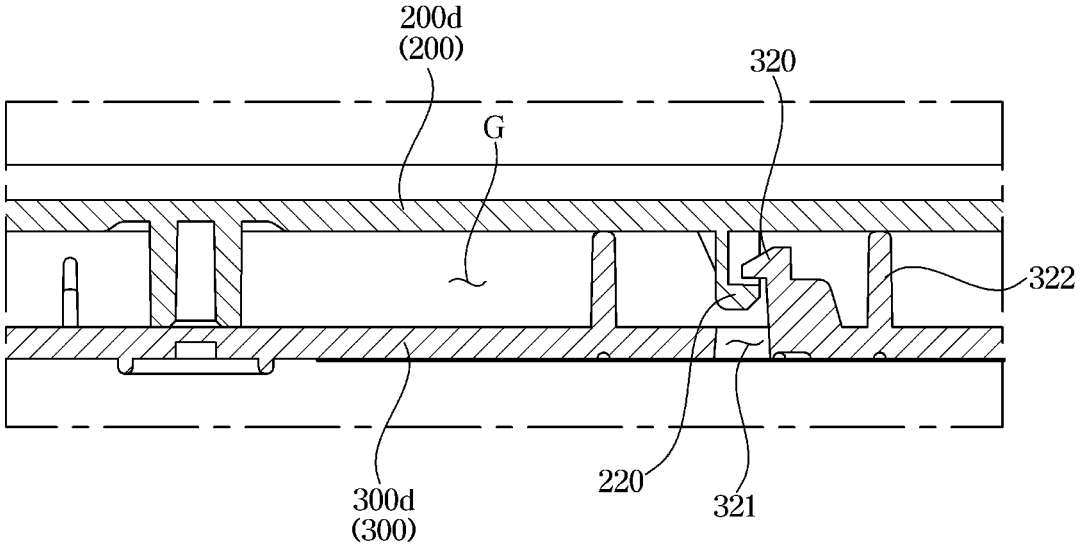
FIG. 31 is an enlarged cross-sectional view taken along line C-C' shown in FIG. 4.
Figure 32:
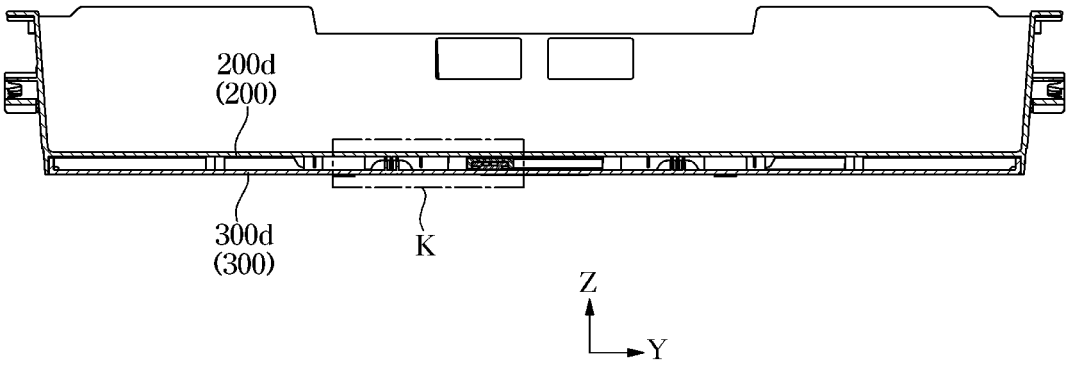
FIG. 32 is a front cross-sectional view of a shelf according to an embodiment of the present disclosure.
Figure 33:
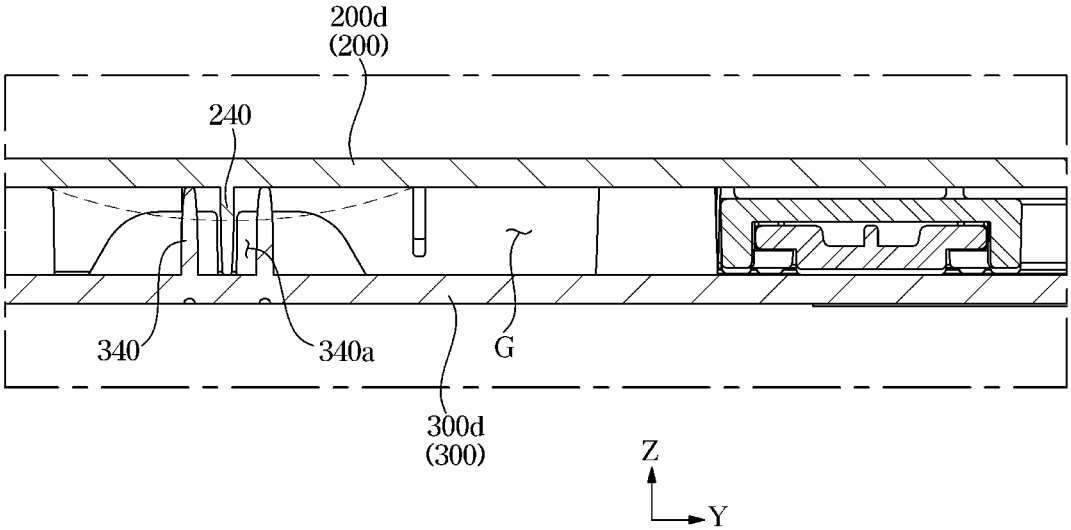
FIG. 33 is an enlarged view of part K shown in FIG. 32.

FIG. 26 is an enlarged cross-sectional view taken along line A-A' shown in FIG. 4. FIG. 27 is a cross-sectional view taken along line B-B' shown in FIG. 4. FIG. 28 is a cross-sectional view taken along line D-D' shown in FIG. 4. FIG. 29 is a cross-sectional perspective view illustrating a combination of a shelf body and a shelf base according to an embodiment of the present disclosure from the rear. FIG. 30 is an enlarged view of area E shown in FIG. 8. FIG. 31 is an enlarged cross-sectional view taken along line C-C' shown in FIG. 4. FIG. 32 is a front cross-sectional view of a shelf according to an embodiment of the present disclosure. FIG. 33 is an enlarged view of area K shown in FIG. 32.

A coupling structure of the shelf body 200 and the shelf base 300 will be described below with reference to FIGS. 26 to 33.

Referring to FIG. 26, the front coupling protrusion 211 protruding rearward (e.g., −X direction) from the front wall 203 of the shelf body 200 may be inserted into the front coupling groove 311 formed on a front surface of the guide wall 303 of the shelf base 300.

The shelf base 300 may include a front locking part 311*a* forming the front coupling groove 311. The front coupling protrusion 211 of the shelf body 200 may be inserted into the front coupling groove 311 to be caught on the front locking part 311*a*. As such, a plurality of the front coupling protrusions 211 of the shelf body 200 and the front coupling grooves 311 of the shelf base 300 may be provided and arranged in the horizontal direction (e.g., Y direction).

When the front coupling protrusion 211 of the shelf body 200 and the front locking part 311*a* of the shelf base 300 are coupled, front portions of the shelf body 200 and the shelf base 300 may be coupled and fixed to each other.

Referring to FIG. 27, the right coupling protrusion 213 protruding inward from the right wall 200*c* of the shelf body 200 may be inserted into the right coupling groove 313 of the shelf base 300. The right coupling protrusion 213 may be bent inward from the right wall 200*c*. Correspondingly, the right coupling groove 313 may be formed on the bottom wall 300*d* of the shelf base 300. A plurality of the right coupling protrusions 213 and the right coupling grooves 313 may be provided and arranged in the front-rear direction (e.g., X direction).

The left coupling protrusion 212 provided on the left wall 200*b* of the shelf body 200 may be inserted into the left coupling groove 312 of the shelf base 300, and this structure may be symmetrical to a structure in which the right coupling protrusion 213 is inserted into the right coupling groove 313.

Referring to FIG. 28, the shelf body 200 may include the rear groove 214 formed at a lower portion of the first rear wall 200*e*. The first rear wall 200*e* may extend downward (e.g., −Z direction) to cover a lower portion of the shelf base 300.

The bottom wall 300*d* of the shelf base 300 may be provided to have a smaller area than the support wall 200*d* of the shelf body 200, and include the rear protrusion 314 protruding toward the shelf body 200 from the first rear wall 300*e* of the shelf base 300.

The rear protrusion 314 may be formed to correspond to a position of the rear groove 214 so as to be inserted into the rear groove 214. A plurality of the rear protrusions 314 and the rear grooves 214 may be provided and arranged in one direction (e.g., X direction), respectively.

When the plurality of rear protrusions 314 is inserted into the plurality of rear grooves 214 and caught on the rear locking part 214*a* of the first rear wall 200*e* of the shelf body 200, rear portions of the shelf body 200 and the shelf base 300 may be coupled and fixed to each other.

As shown in FIG. 8, the second rear coupling protrusion 215 of the shelf body 200 may be inserted into the rear coupling groove 315 of the shelf base 300, and accordingly, the second rear wall 200*f* of the shelf body 200 and the second rear wall 300*f* of the shelf base 300 may be coupled to each other.

As illustrated in FIG. 29, a rear insertion protrusion 255 protruding from a rear surface 210*f* of the shelf body 200 toward the second rear wall 300*f* of the shelf base 300 may be provided. The second rear wall 300*f* of the shelf base 300 may face the rear surface 210*f* of the shelf body 200 and include a rear insertion groove 355 into which the rear insertion protrusion 255 is inserted.

The rear insertion protrusion 255 may be arranged vertically, and the rear insertion groove 355 communicates vertically such that the rear insertion protrusion 255 may be inserted therein.

With this structure, the shelf body 200 and the shelf base 300 may be assembled through the front, left, right, and rear portions, respectively.

Because the shelf body 200 and the shelf base 300 may be wide in the horizontal direction, structures to be fixed to the insides thereof may be required.

Referring to FIGS. 8, 30, and 31, the shelf base 300 may include the hook protrusion 320 formed on the bottom wall 300*d*. The hook protrusion 320 may be a configuration for being hooked to the interference protrusion 220 provided on the bottom surface 210*d* of the shelf body 200.

When the plurality of hook protrusions 320 disposed on an inner side of the shelf base 300 is hooked to the plurality of interference protrusions 220 disposed on an inner side of the shelf body 200, in addition to the coupling structure formed along edges of the shelf body 200 and the shelf base 300, coupling of the inner sides of the shelf body 200 and the shelf base 300 is completed, so that a coupling force between the shelf body 200 and the shelf base 300 may be increased.

It may be difficult to check positions of the plurality of hook protrusions 320 disposed on the inner side the shelf base 300 from the outside. In order to prevent this, the guide hole 321 formed to penetrate the bottom wall 300*d* may be provided at a position adjacent to the hook protrusion 320. The guide hole 321 may be formed such that a hook portion of the hook protrusion 320 is exposed to the outside.

The guide hole 321 may be formed such that the position of the hook protrusion 320 of the shelf base 300 may be checked on the bottom surface 310*g* of the bottom wall 300*d*. Accordingly, the user may press the guide hole 321 so that the hook protrusion 320 is hooked to the interference protrusion 220.

In addition, even when the shelf body 200 and the shelf base 300 are separated, the coupling of the hook protrusion 320 and the interference protrusion 220 may be released by using a sharp member through the guide hole 321. According to this structure, the user may more easily use the shelf 100 because the inner parts of the shelf body 200 and the shelf base 300 may be coupled or separated.

The guide hole 321 may be formed on the bottom wall 300*d* of the shelf base 300, and the shelf base 300 may include a closed rib 322 extending to surround the guide hole 321 to prevent air accommodated in the gap G between the shelf body 200 and the shelf base 300 for the purpose of insulation from being discharged to the outside of the shelf 100 through the guide hole 321.

The closed rib 322 may extend to surround the guide hole 321 and be in contact with the support wall 200*d* of the shelf body 200 to prevent air accommodated between the shelf body 200 and the shelf base 300 from being discharged through the guide hole 321.

With this structure, the shelf body 200 and the shelf base 300 accommodate air in the space therebetween so that insulation may be maintained, and at the same time, the hook protrusion 320 and the interference protrusion 220 may be coupled relatively easily.

Referring to FIGS. 32 and 33, the shelf 100 may be provided to be horizontally longer in a left-right direction (e.g., Y direction) than in the front-rear direction (e.g., X direction). Correspondingly, the shelf body 200 may be provided to be long in the left-right direction (e.g., Y-direction). Because the shelf body 200 stores food on the support wall 200*d*, due to a weight of the food, the support wall 200*d* of the shelf body 200 may receive the weight downward (e.g., −Z direction).

In this case, because the shelf body 200 is provided to be long in one longitudinal direction (e.g., Y direction), the shelf body 200 may be bent downward in the longitudinal direction.

Because the shelf body 200 may no longer support food when bent downward, durability of the shelf body 200 in the longitudinal direction needs to be improved. For this structure, the insertion rib 240 of the shelf body 200 extending in the front-rear direction (e.g., X direction) may be inserted into the support groove 340*a* between the support ribs 340 of the shelf base 300. The support rib 340 and the support groove 340*a* may extend from the bottom wall 300*d* of the shelf base 300 toward the shelf body 200 to be in contact with the support wall 200*d* of the shelf body 200.

The support ribs 340 may be provided as a pair to form the support groove 340*a* in the front-rear direction (e.g., X direction), and the insertion rib 240 may be inserted between the pair of support ribs 340. As such, the pair of support ribs 340 may support the support wall 200*d* of the shelf body 200 with the insertion rib 240 therebetween.

In a case in which there is no configuration of the support rib 340, the shelf body 200 may be bent in a dotted line, and thus the durability may be weak, but due to the configuration of the support ribs 340, the durability of the shelf body 200 may be improved to support food.

Figure 34:
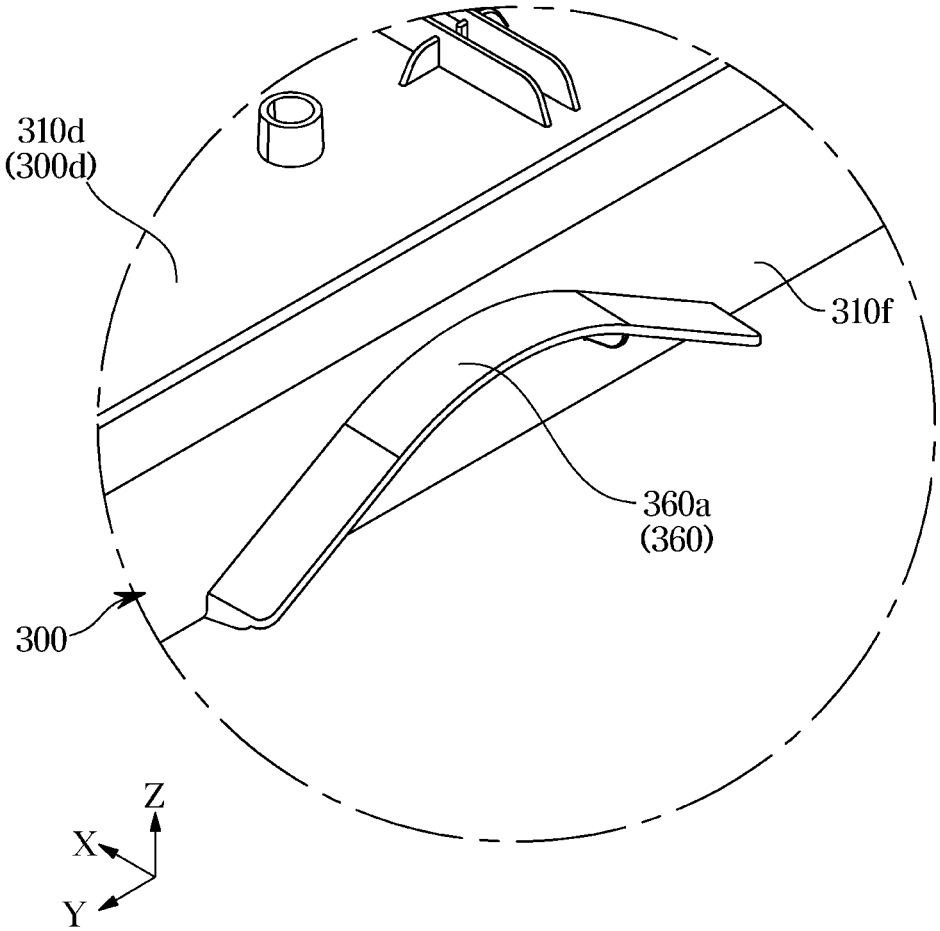
FIG. 34 is an enlarged view of part H shown in FIG. 10.
Figure 35:
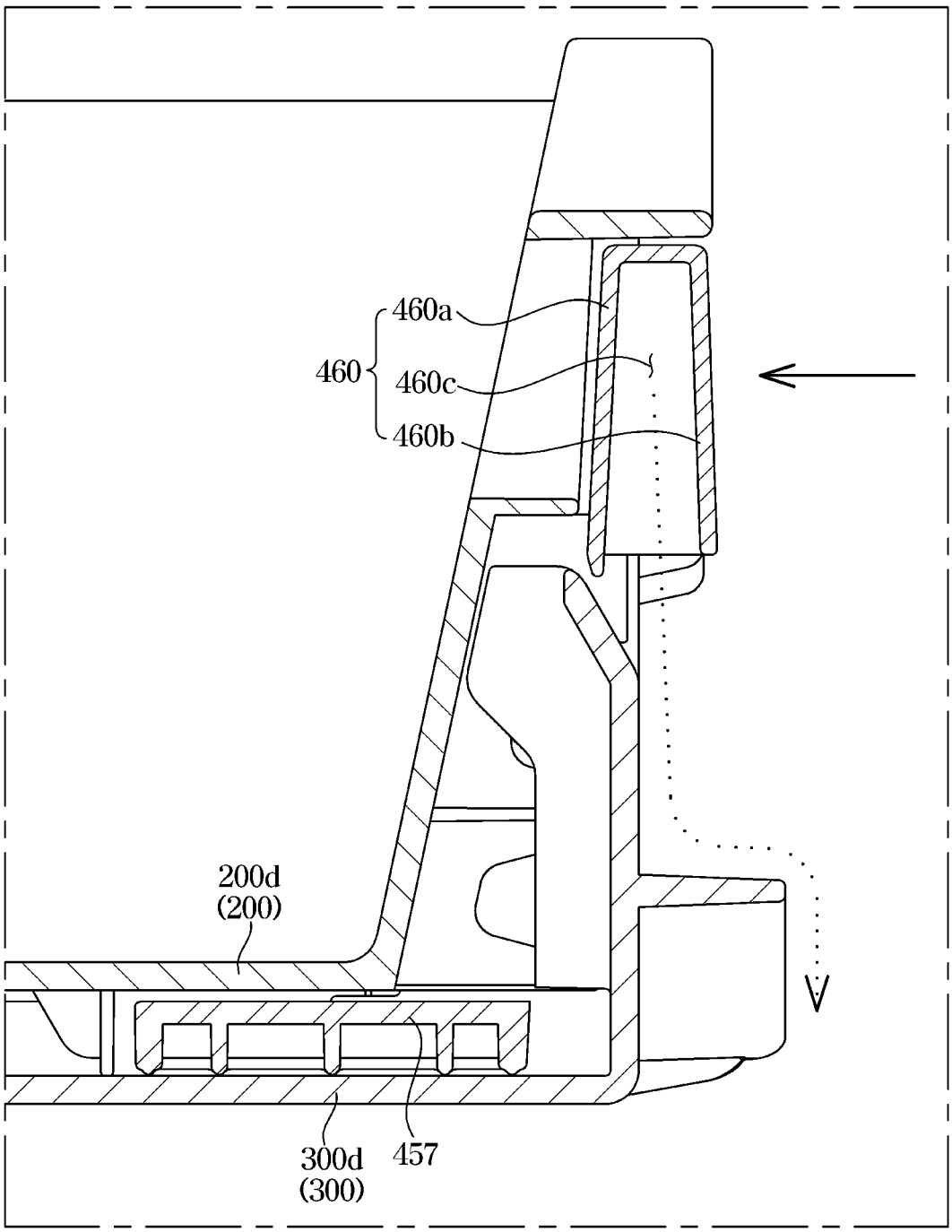
FIG. 35 is an enlarged side cross-sectional view of an opening/closing plate according to an embodiment of the present disclosure.
Figure 36:
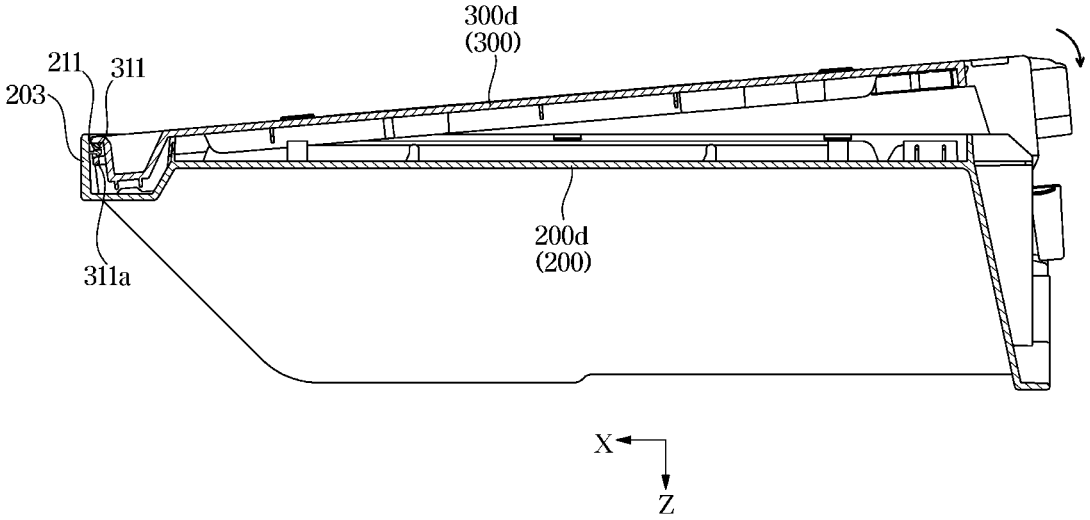
FIGS. 36 to 39 are views illustrating a process in which a shelf body and a shelf base are coupled according to an embodiment of the present disclosure.

FIG. 34 is an enlarged view of area H shown in FIG. 10. FIG. 35 is an enlarged side cross-sectional view of an opening/closing plate according to an embodiment of the present disclosure.

Referring to FIGS. 34 and 35, the shelf base 300 may include the rear rib 360 formed on the second rear surface 310*f*. The rear rib 360 may be formed on the second rear surface 310*f* and provided below the opening/closing part 460 of the shelf 100 (e.g., −Z direction).

The rear rib 360 may have a shape rounded downward in the horizontal direction. The rear rib 360 may also have a downwardly inclined shape.

The opening/closing part 460 may include a first opening/closing wall 460*a*, a second opening/closing wall 460*b*, and a separation space 460*c* formed between the first opening/closing wall 460*a* and the second opening/closing wall 460*b*.

The first opening/closing wall 460*a* and the second opening/closing wall 460*b* of the opening/closing part 460 may be provided to be spaced apart from each other in the front-rear direction (e.g., X direction). More specifically, the first opening/closing wall 460*a* may be connected to the vertical connection plate 458, and the second opening/closing wall 460*b* may be formed by being bent from the first opening/closing wall 460*a*.

Even when the opening/closing part 460 closes the first cold air communication hole 260*a* communicating with the first cold air outlet 60*a* of the cold air outlet 60 (see FIG. 4), cold air may be discharged forward (e.g., X direction) through the first cold air outlet 60*a*.

Air with relatively high humidity may be accommodated in the second refrigerating compartment 21*b* provided in front of the opening/closing part 460. When cold air discharged from the rear of the opening/closing part 460 (e.g., −X direction) encounters air with high humidity with the opening/closing part 460 interposed therebetween, frost may form in an area adjacent to the opening/closing part 460.

According to a structure in which the first opening/closing wall 460*a* and the second opening/closing wall 460*b* of the opening/closing part 460 are spaced apart from each other in the front-rear direction (e.g., X direction) to provide the separation space 460*c* therebetween, frost may form in the separation space 460*c*. When frost forms in the separation space 460*c*, the frost may be invisible to eyes of the user by the first opening/closing wall 460*a*. That is, because frost may be prevented from forming on a front surface of the first opening/closing wall 460*a*, and thus the user does not see frost, the user may feel comfortable in using the refrigerator 1 (see FIG. 1).

On the other hand, when the opening/closing part 460 is provided as a single opening/closing wall, frost may form on a front surface of the single opening/closing wall, so that the frost may be visible to the eyes of the user.

When the cold air control lever 400 is in the second position P2, the opening/closing part 460 may be located at the closed position where the first cold air communication hole 260*a* is closed. In this case, the rear rib 360 of the shelf base 300 may be disposed below the separation space 460*c* of the opening/closing part 460.

When frost formed in the separation space 460*c* of the opening/closing part 460 is forced downward due to gravity or other causes, the frost may move downward through the upper surface 360*a* of the rear rib 360.

According to this structure, because not only is frost invisible to the eyes of the user while the frost that may from in the separation space 460*c* of the opening/closing part 460 is accommodated in the separation space 460*c*, but the frost may fall to the floor of the refrigerating compartment 21 through the rear rib 360 even when moving downward, even while the frost falls to the floor of the refrigerating compartment 21, the frost may be invisible to the eyes of the user.

FIGS. 36 to 39 are views illustrating a process in which the shelf body and a shelf base are coupled according to an embodiment of the present disclosure.

A process of coupling the shelf base 300 and the shelf body 200 will be described in detail below with reference to FIGS. 36 to 39.

In the process of coupling the shelf body 200 and the shelf base 300, it may be relatively easy for the shelf body 200 to be disposed below the shelf base 300 and coupled thereto.

It will be understood that the cold air control lever 400 is seated on the bottom surface 210*d* of the shelf body 200.

The front coupling groove 311 of the shelf base 300 may be positioned corresponding to a position of the front coupling protrusion 211 of the shelf body 200, and the front coupling protrusion 211 may be caught on and fixed to the front locking part 311*a*. As such, because the plurality of front coupling protrusions 211 may be formed to be inserted into the front coupling groove 311 so as to be caught on each of the plurality of front locking parts 311*a*, the front portions of the shelf body 200 and the shelf base 300 may be coupled to each other.

When the front coupling protrusion 211 is inserted into the front coupling groove 311 and caught on the front locking part 311*a*, the rear portion of the shelf base 300 may be rotated while the front portion thereof is fixed. For example, the rear portion of the shelf base 300 may be rotated clockwise.

After the rear portion of the shelf base 300 is rotated, the rear insertion groove 355 of the shelf base 300 may be rotated to correspond to a protruding shape of the rear insertion protrusion 255 of the shelf body 200.

Thereafter, the bottom surface 310*g* of the shelf base 300 may be pressed downward so that along an edge of the bottom surface 310*g* of the shelf base 300 disposed above the shelf body 200, the left coupling protrusion 212 is inserted into the left coupling groove 312, the right coupling protrusion 213 is inserted into the right coupling groove 313, the rear protrusion 314 is inserted into the rear groove 214, and the rear coupling protrusion 215 is inserted into the rear coupling groove 315.

After the edges of the shelf body 200 and the shelf base 300 are coupled, the shelf body 200 and the shelf base 300 may be turned over so that the shelf body 200 is disposed above the shelf base 300. In order to couple the inner sides of the shelf body 200 and the shelf base 300, the hook protrusion 320 and the interference protrusion 220 may be hooked by pressing one of the hook protrusion 320 and the interference protrusion 220 toward the other one. That is, when the support surface 200*g* of the shelf body 200 is pressed against the shelf base 300, the hook protrusion 320 and the interference protrusion 220 may be hooked with each other.

However, the present disclosure is not limited to what is illustrated in the drawings, and the hook protrusion 320 and the interference protrusion 220 may be hooked by pressing a portion adjacent to the guide hole 321 provided on the bottom surface 310*g* of the shelf base 300.

The coupling of the shelf body 200 and the shelf base 300 may be completed through the above process. Through this structure, the combination of the shelf 100 provided with the cold air control lever 400 may be completed.

Figure 40:
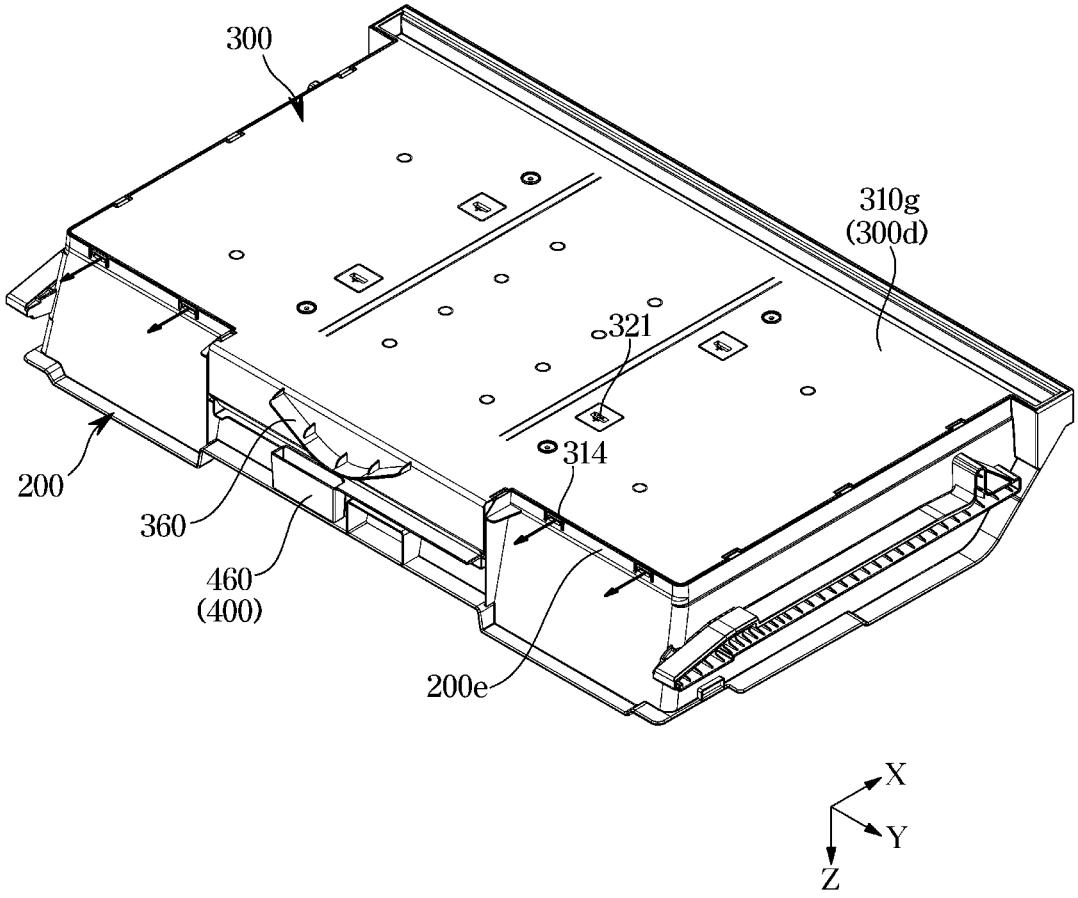
FIGS. 40 to 42 are views illustrating a process in which a shelf base is separated from a shelf body according to an embodiment of the present disclosure.
Figure 41:
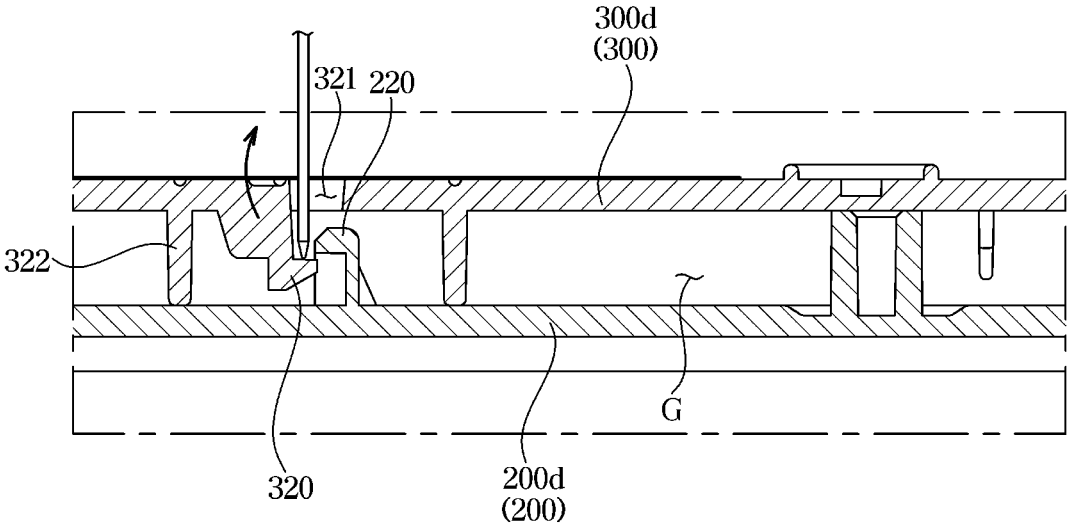
Figure 42:
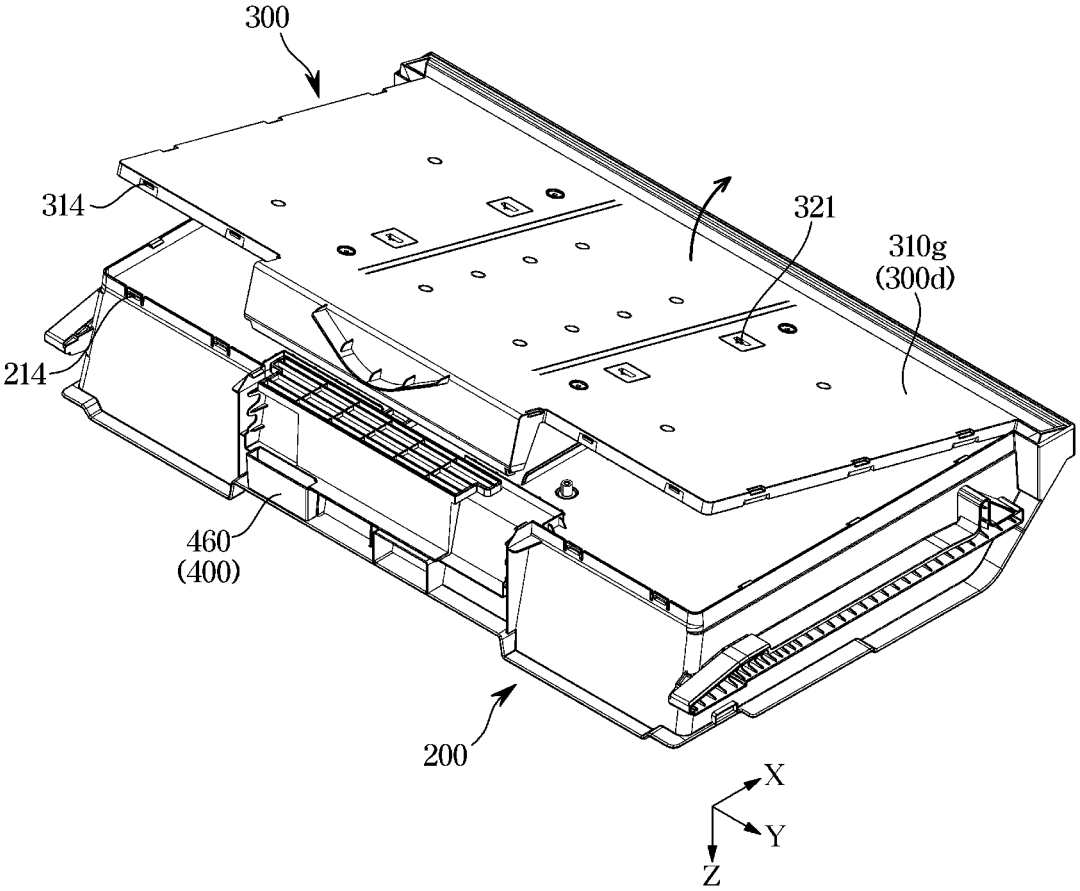

FIGS. 40 to 42 are views illustrating a process in which a shelf base is separated from a shelf body according to an embodiment of the present disclosure.

A structure for separating the shelf base 300 from the shelf body 200 will be described in detail below with reference to FIGS. 40 to 42.

Like the structure in which the shelf base 300 and the shelf body 200 are coupled, the shelf base 300 may be disposed above the shelf body 200. In this state, the rear portion of the shelf base 300 may be separated from the rear portion of the shelf body 200 by pressing the rear locking part 314*a* side of the shelf base 300 rearward (e.g., −X direction).

Thereafter, the hook protrusion 320 formed on the inner side of the shelf base 300 may be separated from the interference protrusion 220 of the shelf body 200 through the guide hole 321 provided on the bottom surface 310*g* of the shelf base 300. In this process, in order to separate the hook protrusion 320 and the interference protrusion 220, a pressing member may be inserted through the guide hole 321 to rotate the hook protrusion 320, and thus the hook protrusion 320 and the interference protrusion 220 may be separated more easily. Because the hook protrusion 320 has elasticity, the hook protrusion 320 may return to an original position thereof after being rotated by the pressing member.

Thereafter, while the coupling structures positioned on both sides of the shelf body 200 and the shelf base 300 are separated, the rear portion of the shelf base 300 may be rotated around the front portion thereof.

Separation of the shelf body 200 and the shelf base 300 may be completed by separating the front coupling protrusion 211 of the shelf body 200 from the front coupling groove 311 of the shelf base 300.

As described above, the coupling structure or separation structure of the shelf body 200 and the shelf base 300 may be relatively easily guided by the plurality of coupling protrusions and the like, and at the same time, the coupling force between the shelf body 200 and the shelf base 300 may be increased.

The foregoing has illustrated and described specific embodiments. However, it should be understood by those of skilled in the art that the present disclosure is not limited to the above-described embodiments, and various changes and modifications may be made without departing from the technical idea of the present disclosure described in the following claims.

What is claimed is:

1. A refrigerator comprising:

a storage compartment;

a cold air outlet configured to supply cold air to the storage compartment; and a shelf within the storage compartment, the shelf comprising:

a cold air communication hole formed at a position corresponding to the cold air outlet;

a shelf body comprising a support wall;

a shelf base below the shelf body and coupled to the shelf body, the shelf base comprising a bottom wall covering the support wall and forming a gap between the bottom wall and the support wall; and a cold air control lever between the bottom wall and the support wall and supported by the bottom wall, the cold air control lever being configured to open and close the cold air communication hole, wherein the shelf body further comprises a cover rib formed on a bottom surface of the shelf body, and wherein the cover rib is configured to extend between the shelf body and the shelf base and to prevent at least a portion of the cold air supplied by the cold air outlet from being introduced into the gap.

2. The refrigerator of claim 1, wherein the cold air control lever is configured to slide between a first position in which the cold air communication hole is open and a second position in which the cold air communication hole is closed, and wherein the cold air control lever is supported by a closed base surface of the shelf base.

3. The refrigerator of claim 2, wherein the cold air control lever comprises a first cold air control lever and a second cold air control lever, wherein the first cold air control lever comprises a switch inserted into a front opening of the shelf body, and wherein the second cold air control lever is at a rear of the first cold air control lever and is configured to open and close the cold air communication hole.

4. The refrigerator of claim 3, wherein the first cold air control lever further comprises a connection part extending toward a rear direction of the shelf and toward the second cold air control lever, and a guider extending from the connection part in a moving direction of the first cold air control lever, wherein the shelf body further comprises a guide rib on the bottom surface of the shelf body, wherein the guide rib extends in a moving direction of the guider, and wherein the bottom surface of the shelf body is in contact with one surface of the guider and is configured to guide a movement of the guider.

5. The refrigerator of claim 3, wherein the shelf base further comprises a guide wall extending along a moving direction of the first cold air control lever, and the guide wall comprises a front surface, and wherein the first cold air control lever comprises a seating part at the rear of the switch and configured to be seated on the guide wall.

6. The refrigerator of claim 5, wherein the first cold air control lever further comprises a guide plate, wherein the guide plate extends in the moving direction of the first cold air control lever and comprises an elastic protrusion protruding toward the front surface of the guide wall, and wherein the shelf base further comprises an interference rib formed on the front surface and configured to interfere with the elastic protrusion as the first cold air control lever is moved from the first position or the second position.

7. The refrigerator of claim 3, wherein the second cold air control lever comprises a supporter configured to receive and support the first cold air control lever.

8. The refrigerator of claim 2, wherein the shelf base further comprises a stopper configured to come into contact with the cold air control lever when the cold air control lever is in one of the first position and the second position.

9. The refrigerator of claim 1, wherein the cold air control lever comprises a first wall configured to open and close the cold air communication hole, and a second wall at the rear of the first wall and spaced apart from the first wall.

10. The refrigerator of claim 9, wherein the shelf base further comprises a rear rib below the first wall and the second wall and protruding from a rear surface of the shelf base to extend downward, and wherein the rear rib is configured to guide frost formed between the first wall and the second wall downward.

11. The refrigerator according to claim 1, wherein the shelf body further comprises an insertion rib extending in a rear direction of the shelf and protruding from the bottom surface of the shelf body toward the shelf base, and wherein the shelf base further comprises a pair of support ribs extending in the rear direction and forming an insertion groove configured to receive the insertion rib.

12. A refrigerator comprising:

a storage compartment;

a cold air outlet configured to supply cold air to the storage compartment; and a shelf within the storage compartment, the shelf comprising:

a cold air communication hole formed at a position corresponding to the cold air outlet;

a shelf body comprising a support wall;

a shelf base below the shelf body and coupled to the shelf body, the shelf base comprising a bottom wall covering the support wall and forming a gap between the bottom wall and the support wall; and a cold air control lever between the bottom wall and the support wall and supported by the bottom wall, the cold air control lever being configured to open and close the cold air communication hole, wherein the shelf base further comprises a hook protrusion protruding toward the shelf body, and wherein the shelf body further comprises an interference protrusion protruding toward the shelf base and configured to interfere with the hook protrusion.

13. The refrigerator of claim 12, wherein the shelf base further comprises a guide hole adjacent to the hook protrusion and formed on a bottom surface of the shelf base.

14. The refrigerator of claim 13, wherein the shelf base further comprises a closed rib surrounding the guide hole, the closed rib configured to protrude toward and come in contact with the shelf body.

15. A shelf assembly comprising:

a shelf body comprising a support wall and a rear wall, the rear wall comprising an opening configured to allow air to enter the shelf body;

a shelf base positioned below the shelf body and configured to be coupled to the shelf body, the shelf base comprising a bottom wall configured to cover the support wall and to form a gap between the bottom wall and the support wall; and an air control lever between the bottom wall and the support wall, supported by the bottom wall, and configured to open and close the opening, wherein the air control lever comprises a first wall configured to open and close the opening, and a second wall at the rear of the first wall and spaced apart from the first wall.

16. The shelf assembly of claim 15, wherein the air control lever is configured to slide between a first position in which the opening is open and a second position in which the opening is closed, and wherein the air control lever is supported by a closed base surface.

17. The shelf assembly of claim 16, wherein the air control lever comprises a first air control lever and a second air control lever, wherein the first air control lever comprises a switch inserted into a front opening of the shelf body, and wherein the second air control lever is at a rear of the first air control lever and is configured to open and close the opening.

18. The shelf assembly of claim 17, wherein the first air control lever further comprises a connection part extending toward a rear direction of the shelf assembly and toward the second air control lever, and a guider extending from the connection part in a moving direction of the first air control lever, wherein the shelf body further comprises a guide rib on a bottom surface of the shelf body, wherein the guide rib extends in a moving direction of the guider, and wherein the bottom surface of the shelf body is in contact with one surface of the guider and is configured to guide a movement of the guider.

* * * * *